US010814164B2

(12) United States Patent
Kwun

(10) Patent No.: US 10,814,164 B2
(45) Date of Patent: Oct. 27, 2020

(54) NECK MUSCLE EXERCISE DEVICE

(71) Applicant: TwoFive Inc., Seoul (KR)

(72) Inventor: Hyung Joon Kwun, Seoul (KR)

(73) Assignee: TwoFive Inc., Seoul (KR)

( * ) Notice: Subject to any disclaimer, the term of this patent is extended or adjusted under 35 U.S.C. 154(b) by 43 days.

(21) Appl. No.: 16/314,827

(22) PCT Filed: Jul. 7, 2017

(86) PCT No.: PCT/KR2017/007297
§ 371 (c)(1),
(2) Date: Jan. 2, 2019

(87) PCT Pub. No.: WO2018/009022
PCT Pub. Date: Jan. 11, 2018

(65) Prior Publication Data

US 2019/0351285 A1 Nov. 21, 2019

(30) Foreign Application Priority Data

Jul. 7, 2016 (KR) ..... 10-2016-0086118
Jul. 7, 2017 (KR) ..... 10-2017-0086315

(51) Int. Cl.
*A63B 23/025* (2006.01)
*A63B 21/16* (2006.01)
(Continued)

(52) U.S. Cl.
CPC ..... *A63B 23/025* (2013.01); *A63B 21/00069* (2013.01); *A63B 21/0407* (2013.01);
(Continued)

(58) Field of Classification Search
CPC ..... A63B 23/025; A63B 21/1609; A63B 21/04074; A63B 21/00069;
(Continued)

(56) References Cited

U.S. PATENT DOCUMENTS 2,855,202 A * 10/1958 Kinne ..... A63B 23/025 482/10
3,596,655 A * 8/1971 Corcoran ..... A61H 1/008 602/32
(Continued)

FOREIGN PATENT DOCUMENTS

KR 10-1546974 8/2015
KR 10-1602603 3/2016

OTHER PUBLICATIONS

International Search Report dated Sep. 29, 2017 for PCT/KR2017/007297.

*Primary Examiner* — Loan B Jimenez
*Assistant Examiner* — Kathleen Vermillera

(57) ABSTRACT

The present invention relates to a neck muscle exercise device includes: a main body part; a chair part provided at the main body part, having a seat part for supporting the buttocks of a user such that the user sits thereon, and formed such that the height of the seat part can be adjusted by an electric cylinder; and push exercise parts provided at the main body part so as to be arranged at the upper part of the chair part, and applying resistance to a motion, in which the user sitting on the chair part pushes the head thereof in at least one direction, so as to strengthen the neck muscle of the user.

20 Claims, 24 Drawing Sheets

(51) Int. Cl.
*A63B 21/00* (2006.01)
*A63B 21/04* (2006.01)
*A63B 21/055* (2006.01)

(52) U.S. Cl.
CPC ..... *A63B 21/1609* (2015.10); *A63B 21/0552* (2013.01); *A63B 2208/0233* (2013.01)

(58) Field of Classification Search
CPC ..... A63B 21/0552; A63B 21/00; A63B 21/04; A63B 2208/0233; A63B 1/00; A61H 1/00; A61H 1/02; A61H 1/0292; A61H 1/0296; A61H 2201/0107; A61H 2201/0149; A61H 2201/12; A61H 2201/1253; A61H 2201/1261; A61H 2201/1269; A61H 2201/16; A61H 2201/1602; A61H 2201/1604; A61H 2201/1607; A61H 2201/1609; A61H 2201/1611; A61H 2201/1614; A61H 2201/1619; A61H 2201/1621; A61H 2201/1623; A61H 2201/1626; A61H 2201/1664; A61H 2201/1669; A61H 2201/1671; A61H 2201/1676; A61H 2203/0425; A61H 2203/0431; A61H 2205/02; A61H 2205/04; A61H 2205/08; A61H 2205/081
See application file for complete search history.

(56) References Cited

U.S. PATENT DOCUMENTS

| | | | | | |
|---|---|---|---|---|---|
| 4,278,249 | A * | 7/1981 | Forrest | A63B 23/025 | 482/10 |
| 4,768,779 | A * | 9/1988 | Oehman, Jr. | A63B 23/025 | 482/10 |
| 4,893,808 | A | 1/1990 | McIntyre et al. | | |
| 5,116,359 | A | 5/1992 | Moore | | |
| 5,336,138 | A * | 8/1994 | Arjawat | A63B 23/025 | 482/10 |
| 5,360,383 | A * | 11/1994 | Boren | A63B 23/0244 | 482/10 |
| 5,984,836 | A * | 11/1999 | Casali | A63B 21/0552 | 482/10 |
| 5,997,440 | A * | 12/1999 | Hanoun | A61B 5/1121 | 482/10 |
| 8,876,665 | B1 * | 11/2014 | Isom | A63B 23/025 | 482/10 |
| 2003/0148863 | A1 * | 8/2003 | Thomas | A63B 21/00047 | 482/122 |
| 2011/0111925 | A1 | 5/2011 | Hobson et al. | | |

* cited by examiner

NECK MUSCLE EXERCISE DEVICE

TECHNICAL FIELD

The present disclosure relates to a neck muscle exercise device, and more specifically, to a neck muscle exercise device capable of performing a neck muscle exercise in any of front, back, left and right directions while a user is seated and fastened so that user's upper and lower bodies are not moved.

BACKGROUND ART

Generally, sitting on a chair, using a computer, driving, studying or the like often involves eyes fixed in certain direction and this can result in stiff neck and difficulty in blood circulation and subsequent neck pain.

Many people nowadays suffer from neck diseases due to various reasons including those described above.

While there are simple stretching exercises one can do with his hands, in order to prevent or rehabilitate these neck diseases, a neck muscle exercise device has been developed and used to perform a more efficient neck muscle exercise.

Such a related neck muscle exercise device is disclosed in Korean Patent Registration No. 10-1546974.

However, the neck muscle exercise device described above has a disadvantage in that a user is able to perform neck muscle exercise in only one direction while the user is seated, so that the user has to change his sitting posture to the intended direction of the neck muscle exercise, which is inconvenient.

In other words, the user has inconvenience of using the device, since after completing left neck muscle exercise while sitting in the chair in the left direction to perform neck muscle exercise in the left direction, the user has to change the sitting posture to the sitting posture in the chair in the right direction to perform the neck muscle exercise in the right direction, and then likewise change the sitting posture for the neck muscle exercise in the forward and backward directions.

In addition, the related neck muscle exercise device has a problem in that the neck muscle exercise is performed without keeping the upper body, lower body, jaw and the like from moving, which results in muscles other than the neck muscles, such as the shoulder muscles, and the like being contracted too, thus preventing effective strengthening of the neck muscles.

DISCLOSURE OF THE INVENTION

Technical Problem

The present disclosure has been devised to solve the related problems as described above, and it is an object of the present disclosure to provide a neck muscle exercise device having an improved structure, which is capable of enabling a user to sit in a chair and perform neck muscle exercises in all of four directions of front, back, left and right directions.

In addition, another object of the present disclosure is to provide a neck muscle exercise device having an improved structure, which is capable of improving the effect of the neck muscle exercises by performing the neck muscle exercises while the user is seated in the chair with the user's body being fastened to restrict the movement thereof, and enabling the user to perform the neck muscle exercises in all of four directions of front, back, left and right directions.

Technical Solution

A neck muscle exercise device according to an aspect of the present disclosure may include: a main body part; a chair part provided at the main body part, having a seat part for supporting the buttocks of a user such that the user sits thereon, and formed such that the height of the seat part can be adjusted by an electric cylinder; and push exercise parts provided at the main body part so as to be arranged at an upper part of the chair part, and applying resistance to a motion of the user who is sitting on the chair part and pushing his head in at least one direction, so as to strengthen the neck muscle of the user in which the push exercise parts are formed into four parts, and each of the four push exercise parts is provided at the main body part so as to be respectively arranged at front, back, left and right sides of the upper part of the chair part, and applies resistance to a motion of the user who is sitting on the chair part and pushing his head in any of the front, back, left and right directions, so as to strengthen the neck muscle of the user.

The main body may include a base frame supported on a floor, and a vertical frame provided perpendicularly to the base frame and having the push exercise parts provided thereon.

The chair part further may include a backrest part provided at the vertical frame to support a back of a user.

The neck muscle exercise device may further include a fastening member provided on the chair part to fasten a body of the user who is seated in the chair part to restrict a movement of the user, and the fastening member may include lower body fastening members provided at both ends of the seat part to band thighs of the user to restrict the movement of the user, and upper body fastening members provided at both ends of the backrest part to band an upper body of the user located in front of the backrest part to restrict movement.

The vertical frame may include a pair of side beams disposed on left and right sides of the seat part, respectively, and a rear beam disposed in back of the seat part.

The push exercise part may include a front exercise part provided on a left side beam of the pair of side beams to strengthen the neck muscle by imparting resistance against a motion of the user pushing his head to a front direction, a backward exercise part provided on a right side beam of the pair of side beams to strengthen the neck muscle by imparting resistance against a motion of the user pushing his head to a back direction, and left and right exercise parts provided on the rear beam to strengthen the neck muscle by imparting resistance against a motion of the user pushing his to left and right directions.

Each of the left and right exercise parts, the rear exercise part and the front exercise part may include a pivot bar pivotably provided on the vertical frame, an extension bar extending from the pivot bar and having a terminal end positioned on front, back, left, or right side of the head of the user, a head contact part provided on the extension bar to be contacted with the front, back, left, and right sides of the head of the user, and an elastic member provided to connect the vertical frame and the pivot bar to impart a resistance to the neck of the user with respect to a motion of the user pushing the head contact part to front, back, left and right directions.

The vertical frame may be provided with a spring fixing member thereon for fixing one end of the elastic member, and the spring fixing member may be vertically adjustable in position.

The neck muscle exercise device may further include a tension adjusting rod for adjusting tension of the elastic member, which is rotatably provided in the vertical frame and coupled with the spring fixing member in a ball-screw manner to vertically adjust the position of the spring fixing member when a handle provided at upper end is rotated.

The neck muscle exercise device may further include shoulder cushion part provided on the pair of side beams to fix and support a shoulder of the user sitting in the chair part.

The front exercise part may further include a hydraulic absorber which is provided to connect the pivot bar and the vertical frame to reinforce a force by which the pivot bar is restored to the original state by the elastic member after user pushes the head contact part to the front direction.

The front exercise part may include a support provided at an end of the extension bar, and the head contact part provided on the support, and the support may be disposed upward at the end of the extension bar to allow the user to sit in the chair part, or during the neck exercise, the support may be disposed downward at the end of the extension bar so that the support is positioned in front of the head of the user.

Each of the backward exercise part, and the left and right exercise parts may be provided so as to be able to adjust an angle of the pivot bar with respect to the vertical frame, such that the head contact part is placed away from the head of the user to a position farther away from an area where the neck exercise is performed.

Advantageous Effects

The present disclosure gives the following effects. As described above, the present disclosure has an effect that a user can sit in a chair and perform neck muscle exercises in four directions of front, back, left and right directions without changing from one sitting posture to another, thereby enhancing neck exercise efficiency. Further, the present disclosure has an effect that that the user can perform the neck muscle exercise in a correct posture while the user is seated with his lower and upper bodies being held from moving, thereby further enhancing the neck motion efficiency.

MODE FOR CARRYING OUT THE INVENTION

Figure 1:
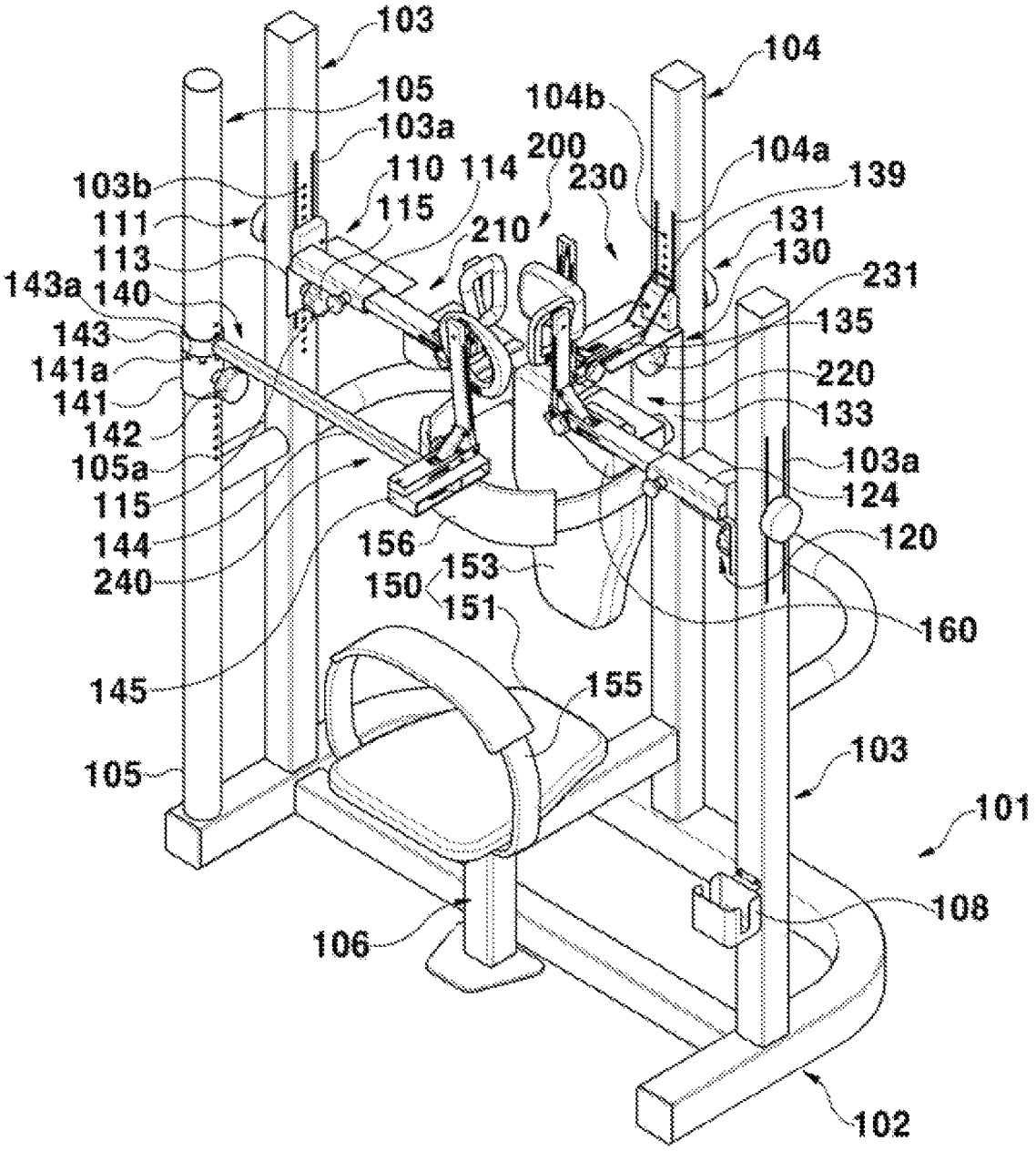
FIG. 1 is a perspective view of a neck muscle exercise device according to a first embodiment of the present disclosure.

These and other objects, features and advantages of the present disclosure described above will be more readily understood from the following detailed description of preferred embodiments with reference to the attached drawings. However, the present disclosure is not limited to the embodiments described herein, and may be realized in other forms. In addition, the embodiments disclosed herein are provided for thorough and complete description of the disclosure, and to help those skilled in the art fully understand the concept of the disclosure.

Throughout the description, when an element is referred to as being on another element, it may mean that the element may be directly formed on another element or a third element may be interposed therebetween. Also, in the drawings, the thickness of the components may be exaggerated for an effective description of the technical content.

Embodiments provided herein will be described with reference to cross-sectional views and/or plan views which are the ideal illustrations of the present disclosure. In the drawings, the thicknesses of the films and regions may be exaggerated for an effective description of the technical content. Thus, forms of the illustrations may be modified depending on manufacturing techniques, and/or tolerances, and the like. Accordingly, the embodiments of the present disclosure are not limited to the specific forms shown, but also include changes in the forms that are generated according to the manufacturing process. For example, an etching region shown at right angles may have a form that is rounded or that has a certain curvature. Thus, the regions shown in the drawings have attributes, and the shapes of the regions shown in the drawings are intended to illustrate specific forms of regions of the elements and are not intended to limit the scope of the disclosure. It should be noted that while the terms "first", "second", and the like are used to describe various components in various embodiments of the present disclosure, these components are not limited by these terms. In addition, it should be noted that these terms are merely used to distinguish one element from another. The embodiments described and exemplified herein also include their complementary embodiments.

The terminology used herein is for illustrating embodiments, and is not intended to limit the present disclosure. Throughout the description, singular forms include plural forms unless the context clearly dictates otherwise. The terms "comprises" and/or "comprising" used herein mean that the element does not exclude the presence or addition of one or more other elements.

In describing specific embodiments below, various specific details will be set forth in order to explain the disclosure in greater detail and to assist in understanding the disclosure. However, those skilled in the art having knowledge enough to understand the present disclosure will be able to appreciate that the present disclosure may be practiced without these specific details. In some instances, portions of the disclosure that are commonly known in the art and that are not largely related to the disclosure will not be described in order to prevent confusion in explaining the present disclosure without any particular reason.

Hereinafter, a neck muscle exercise device according to a first embodiment of the present disclosure will be described with reference to FIGS. 1 to 10. The neck muscle exercise device according to an exemplary embodiment is a device that can be applied for a variety of purposes including the neck rehabilitation exercise of a patient or the neck exercise of a normal person.

Figure 2:
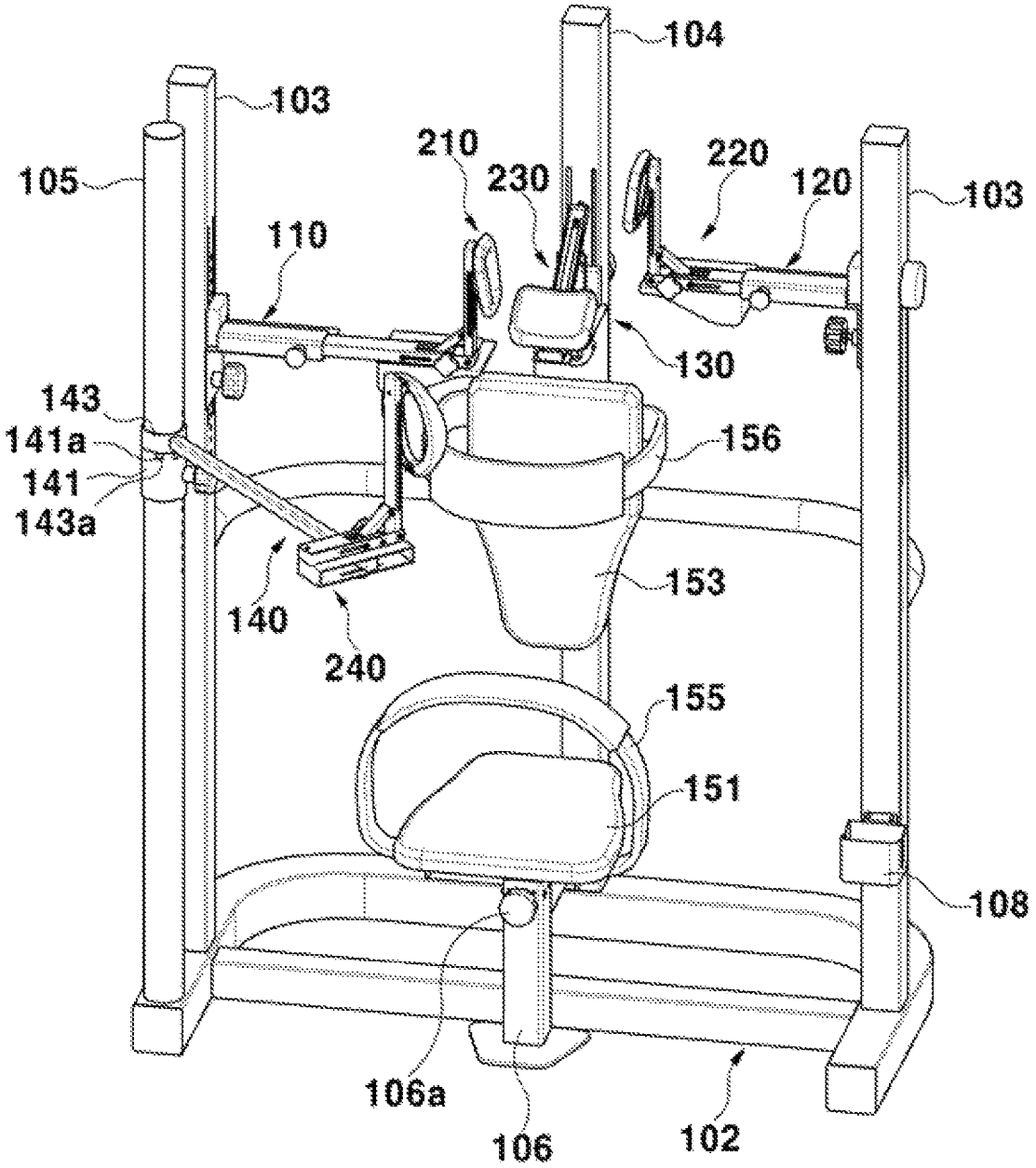
FIG. 2 is a view showing a state in which a position of the push exercise part shown in FIG. 1 is adjusted.
Figure 3:
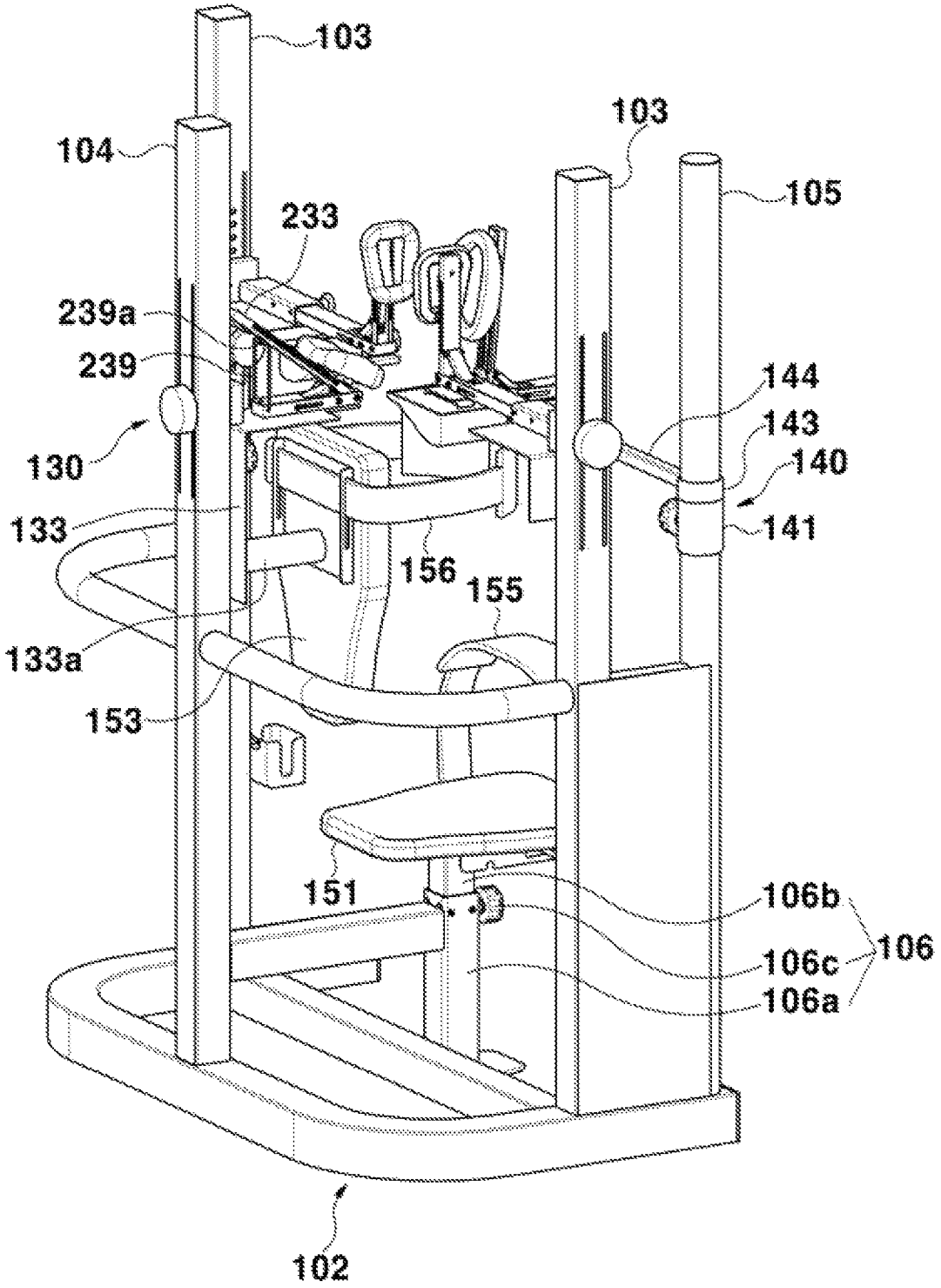
FIG. 3 is a view of the neck muscle exercise device of FIG. 1 seen from behind, showing a state in which a shape of a backward exercise part is changed.

Referring to FIGS. 1 to 3, the neck muscle exercise device according to an exemplary embodiment includes a chair part 150, fastening members 155 and 156, and push exercise parts 200. The chair part 150 and the push exercise parts 200 are provided at the main body part 101.

The main body part 101 includes a base frame 102 supported on the floor, and vertical frames 103, 104 and 105 extending perpendicularly upward from the base frame 102. The vertical frames 103, 104 and 105 include a pair of side beams 103 provided on left and right sides of the seat part 151 with respect to the seat part 151 of the chair part 150, a rear beam 104 provided at the rear of the seat part 151, and a front beam 105 provided in front of one of the pair of side beams 103 and in front of one side of the seat part 151. In the present embodiment, the front beam 105 is provided in front of the right side of the seat part 151, that is, in front of the right-side beam 103 positioned on the right side.

The side beams 103 and the rear beam 104 have a form of a square tube, and the front beam 105 has a form of a circular tube.

A pair of slits 103*a* are formed on the upper parts of the pair of side beams 103 along a longitudinal direction on the front and rear sides with respect to the seat part 151, and a plurality of pinhole 103*b* are formed between the pair of slits 103*a* at predetermined intervals along the longitudinal direction.

Likewise, a pair of slits 104*a* are formed on an upper part of the rear beam 104 along the longitudinal direction on the front and rear sides with respect to the seat part 151, and a plurality of pinhole 104*b* are formed between the pair of slits 104*a* at predetermined intervals along the longitudinal direction.

A plurality of pinholes 105*a* are formed on the side surface of the upper part of the front beam 105 in the longitudinal direction.

The side beams 103, the rear beam 104 and the front beam 105 are provided with brackets 110, 120, 130, and 140 for holding the components of the push exercise parts 200, that is, the left exercise part 210, the right exercise part 220, the backward exercise part 230, the front exercise part 240 thereon, respectively.

The brackets 110, 120, 130, and 140 include left and right support brackets 110 and 120 provided on the pair of side beams 103 respectively to face each other, a rear support bracket 130 provided on the rear beam 104 to face forward, and a front support bracket 140 provided on the front beam 105.

Since the left and right support brackets 110 and 120 have the same structure as each other, only the structure of the left support bracket 110 will be described.

Figure 5:
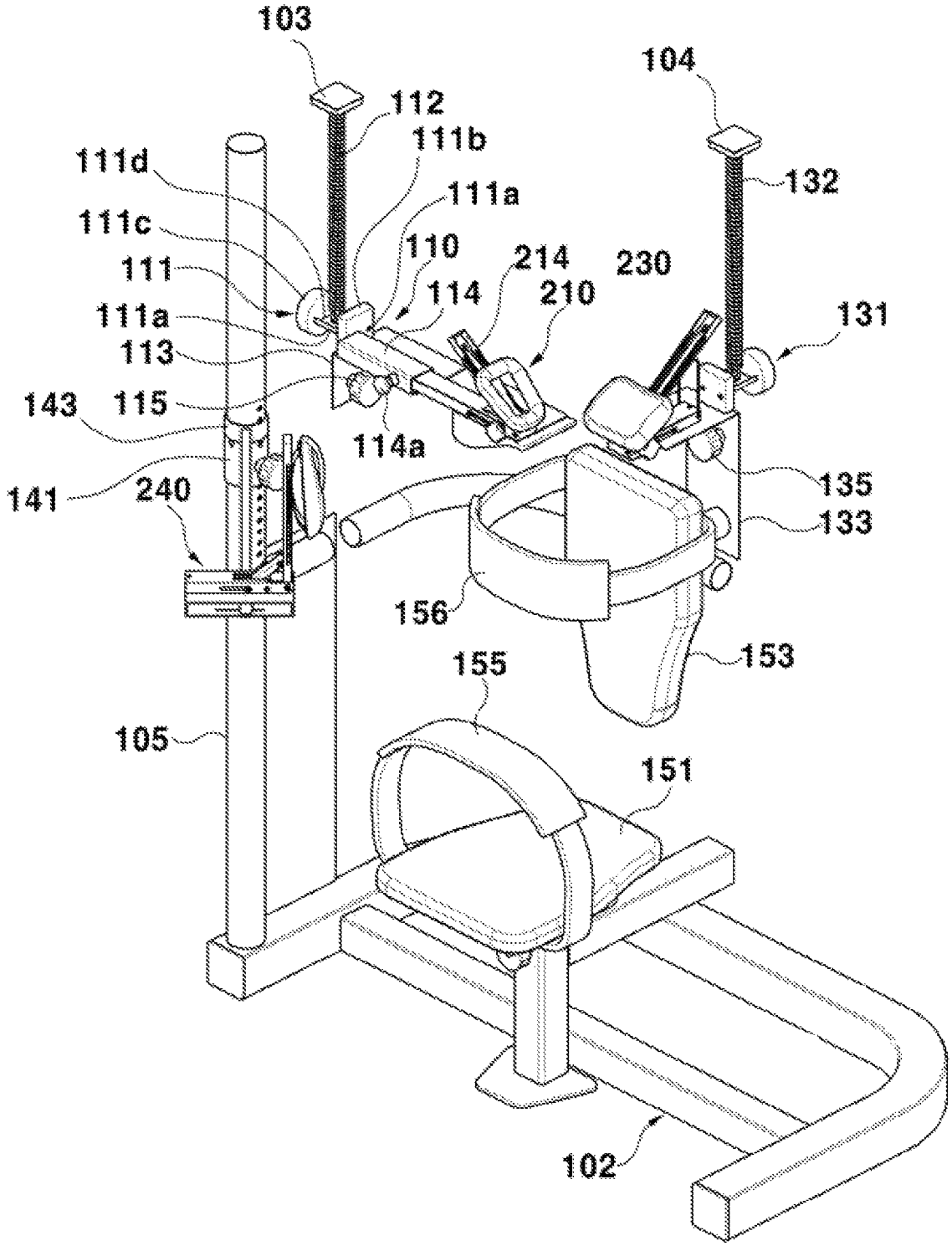
FIG. 5 is a view of FIG. 4 from which components are omitted except for upper ends of the side beams and the rear beams.

Referring to FIGS. 1, 2, and 5, the left support bracket 110 includes a sliding member 111 slidably provided to be slid up and down along the side beam 103, an angle 113 fixed to the sliding member 111 and formed in an "¬" shape, a support beam 114 horizontally fixed on an upper surface of the angle 113 and provided with the left exercise part 210 on an inner side thereof, and a pin member 115 passed into a side wall of the angle 113 to be inserted into any of the plurality of pinholes 103*b* to fix the vertical position of the sliding member 111.

Specifically, the sliding member 111 includes a pair of penetrating bars 111*a*, a front block 111*b*, a rear block 111*c*, and a connecting piece 111*d*.

The pair of penetrating bars 111*a* are respectively provided to pass through a pair of slits 103*a* formed on the side beams 103 in front and rear directions. The front ends of the pair of penetrating bars 111*a* protrude from the front surfaces of the side beams 103 and the rear ends thereof protrude from the rear surfaces of the side beams 103. The front block 111*b* is fixedly provided to receive the front ends of the pair of penetrating bars 111*a* inserted therein, and the rear block 111*c* is fixedly provided to receive the rear ends of the pair of penetrating bars 111*a* inserted therein. The angle 113 is fixedly formed on the lower surface of the front block 111*b* by a fastening means such as a bolt (not shown).

The connecting piece 111*d* is provided to connect the pair of penetrating bars 111*a* to each other within the side beam 103.

With the configuration described above, the front block 111*b* and the rear block 111*c* are guided into the slits 103*a* to be slid up and down along the longitudinal direction of the side beams 103.

The user may position the sliding member 111 at a predetermined height with respect to the side beams 103 and then insert the pin member 115 into any pinhole 103*b* to fix the vertical position of the sliding member 111. Accordingly, the height of the left exercise part 210 may be adjusted.

Meanwhile, according to an embodiment, for adjusting position by raising or lowering the sliding member 111, a spring 112 may be disposed inside the upper part of the side beam 103 with an upper end of the spring 112 being fixed to the upper end of the side beam 103 and a lower end of the spring 112 being fixed to the connecting piece 111*d*, in which case the user is able to move the position with less force while releasing the pin member 115 from the pinhole 103*b* and then raising or lowering the sliding member 111 to adjust the position.

Thus, when the user raises or lowers the sliding member 111 to adjust the height of the left exercise part 210, the elastic force of the spring 112 reduces a burden of the user of raising or lowering the weight of the left exercise part 210.

The rear support bracket 130 has the same configuration as that of the left support bracket 110, with only difference of the absence of the support beam 114.

The left support bracket 110 has a configuration in which the support beam 114 is provided on the upper surface of the angle 113 and the left exercise part 210 is provided on the support beam 114, and the rear support bracket 130 has a configuration in which the backward exercise part 230 is directly provided on the front end of the angle 133.

Specifically, the rear support bracket 130 includes a sliding member 131, an angle 133 and a pin member 135, in which the sliding member 131 is slidable in the vertical direction of the rear beam 104 through the same structure as that of the sliding member 111 provided on the left support bracket 110.

The angle member 133 may be fixedly provided on the lower surface of the front block 131*b* of the sliding member 131 and the pin member 135 may be passed through the side wall of the angle 133 to be inserted into any pinhole 104*b* formed in the rear beam 104 to adjust the height of the backward exercise part 230.

Like the left support bracket 110, the rear support bracket 130 according to an exemplary embodiment may include a spring 132 so that the user more easily adjusts up and down the height of the backward exercise part 230.

Figure 4:
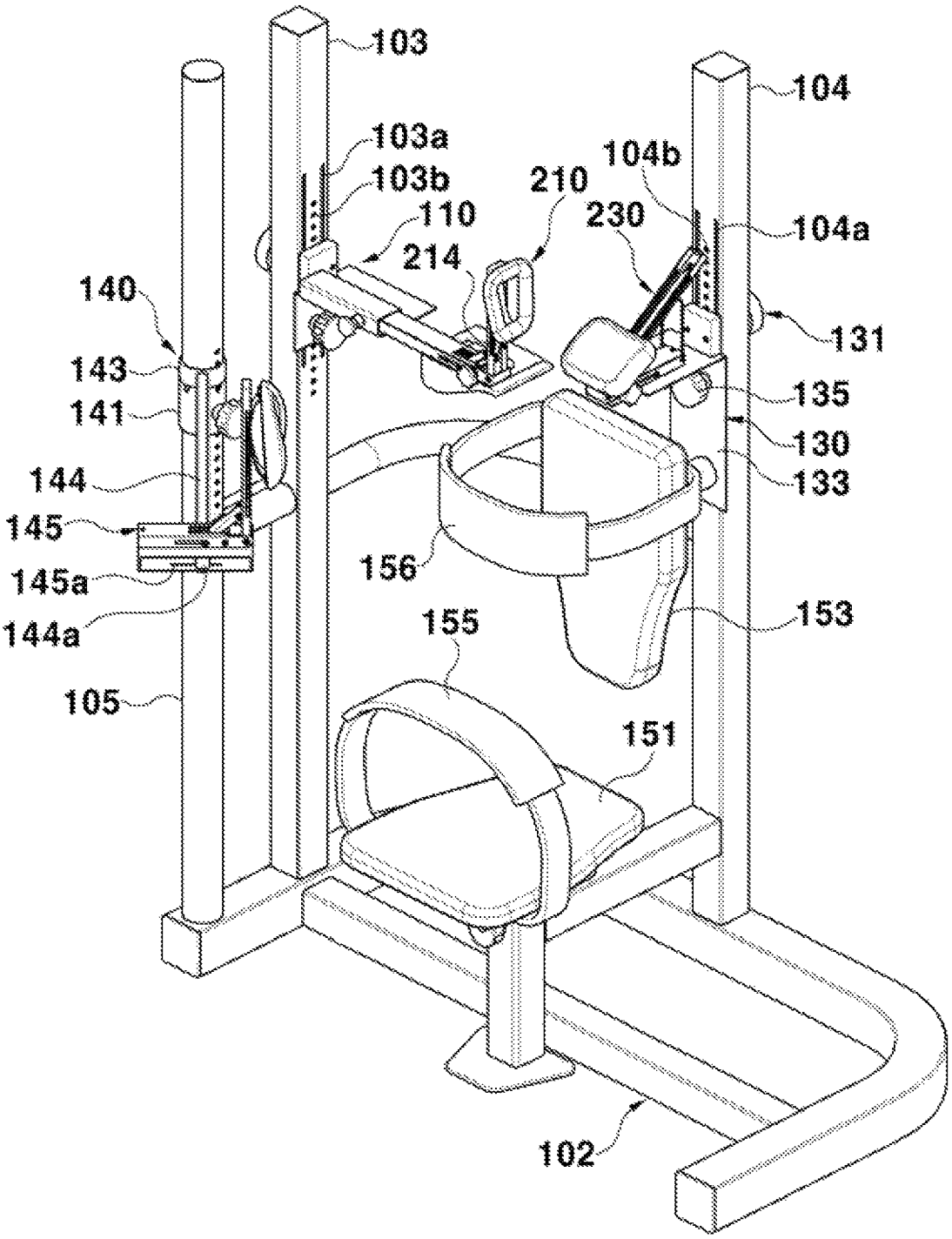
FIG. 4 is a view of FIG. 1 from which some components are omitted, showing a state in which the shape of the backward exercise part is changed.

Referring to FIGS. 1 and 4, the front support bracket 140 includes a lower cylinder 141, an upper cylinder 143, an extension bar 144, and a support 145.

The lower cylinder 141 receives the front beam 105 inserted therein and is movable up and down along the front beam 105, and has a plurality of coupling grooves 141*a* formed on an upper circumference at predetermined intervals. A pin member 142 (same as the pin member 115 of the left support bracket 110) is provided on the side surface of the lower cylinder 141, and the pin member 142 may be inserted into any one of the plurality of pinholes 105*a* formed in the front beam 105 to fix the vertical position of the lower cylinder 141.

The upper cylinder 142 is formed in the shape of a cylinder having the same diameter as the lower cylinder 141, and has a coupling protrusion 143*a* at a lower end thereof for insertion into the coupling groove 141*a*, and an extension bar 144 integrally extending laterally and horizontally from the upper cylinder 142.

The extension bar 144 integrally extends laterally from the upper cylinder 142 and the support 145 is provided perpendicularly on a terminal end 144*a*.

The support 145 has a form of a rectangular box with left and right openings, receives the terminal end 144*a* of the extension bar 144 that is perpendicularly inserted therein, and has the front exercise part 240 fixed on the upper surface thereof.

The support 145 has a long hole 145*a* penetrating longitudinally along a lower surface, with a tightening bolt 145*b* (see FIG. 6) provided in the long hole 145*a* such that the tightening bolt 145*b* is fastened to the terminal end 144*a* of the extension bar 144 inserted in the support 145.

Therefore, the user may tighten the tightening bolt 145*b* to fix the support 145 to the extension bar 144, and release the tightening bolt 145*b* to adjust the front and rear positions where the terminal end 144*a* of the extension bar 144 is inserted into the support 145 and tighten the tightening bolt 145*b* again to adjust the front and rear positions the front exercise part 240 is provided.

In addition, the user grabs and lifts the extension bar 144 to cause the coupling protrusion 143*a* of the upper cylinder 143 to be separated from the coupling groove 141*a* of the lower cylinder 141, and then rotates the extension bar 144 at a predetermined angle and then lowers down the extension bar 144 so that the coupling projection 143*a* is coupled with the coupling groove 141*a* formed in another position, thereby adjusting the position of the front exercise part 240.

Meanwhile, in the present disclosure, a cup-shaped storage unit 108 may be provided at one side of the vertical frame 103 to store personal belongings such as a smart phone.

The chair part 150 includes a seat part 151 and a backrest part 153. The seat part 151 is provided on an upper part of a central portion of the base frame 102 to support the buttocks of the user. At this time, a length-adjustable center rod 106 is provided at the center of the base frame 102, and the seat part 151 is provided at the upper end of the center rod 106.

When the user is seated in the seat part 151, the push exercise parts 210, 220, 230, and 240 are disposed on the left, right, front and back of the head of the user, respectively.

In the present disclosure, as shown in FIG. 3, the center rod 106 may be configured such that an outer tube 106*a* is provided perpendicularly to the center of the base frame 102, an inner tube 106*b* is inserted into the outer tube 106*a* to be moved up and down and inserted and withdrawn, and the height of the seat part 151 is adjusted by the fixing pin 106*c*. However, it is to be noted that the present disclosure is not limited to the above, and the center rod 106 may be formed as other known forms of center rods as provided in the general chair, as long as the height of the seat part 151 can be adjusted.

The backrest part 153 is fixedly provided in front of the angle 133 of the rear support bracket 130 to support the back of the user sitting on the seat part 151. At this time, a rod 133*a* protrudes from the front surface of a lower part of the angle 133, and the backrest part 153 is fixedly provided on a front end of the rod 133*a*.

Since the backrest part 153 is fixed to the angle 133, the height of the backrest part 153 may be adjusted by adjusting up and down the position of the rear support bracket 130.

The fastening members 155 and 156 are provided to fasten the body of the user who is seated in the chair part 150 to restrict the movement of the user and have a form of a fastening band such as a belt.

The fastening members 155 and 156 include a lower body fastening member 155 for fixing the lower body of the user and an upper body fastening member 156 for fixing the upper body of the user. The lower body fastening member 155 is provided on both ends of the seat part 151 to wrap around the thighs (lower body) of the user to restrict movement, and the upper body fastening member 156 is provided on both ends of the backrest part 153 to wrap around the upper body of the user to restrict movement.

The push exercise part 200 includes four exercise parts, i.e., the left exercise parts 210, the right exercise part 220, the backward exercise part 230, and the front exercise part 240. Each of the push exercise parts 210, 220, 230, and 240 are provided on inner ends (terminal ends) of the brackets 110, 120,130, and 140 From the overall viewpoint, since each of the push exercise parts 210, 220, 230, and 240 are almost same except for a mere difference in the installation positions and the configuration of the head contact parts 218, 228, 238, and 248, the common configurations will be described with reference to the left exercise part 210 as a representative example, and then the configurations different from the those of the left exercise part 210 will be described individually.

Referring to FIGS. 1, 6 to 8, the left exercise part 210 is provided on a front end of the support beam 114 of the left support bracket 110. The left exercise part 210 includes a horizontal bar 211, a vertical bar 213, a link bar 215, an elastic member 217 and the head contact part 218.

The horizontal bar 211 has a form of a rectangular container having a space defined therein, and a through hole 211*ba* formed in an upper surface thereof. Specifically, the horizontal bar 211 includes a rectangular casing 211*a* having an open top and a cover plate 211*b* covering the top of the casing 211*a*. A through hole 211*ba* is formed in one side of the cover plate 211*b*.

The horizontal bar 211 is inserted into the support beam 114 and moved back and forth, and may be fixed in the support beam 114 by the tightening bolt 114*a* (see FIG. 6) formed on one side of the support beam 114.

The vertical bar 213 is inserted into the terminal end of the horizontal bar 211, stands upright, and is hinged by a hinge h1. That is, the vertical bar 213 is pivotable between a first state (see FIG. 1) of being perpendicular to the horizontal bar 211 and a second state (see FIG. 10) in which the vertical bar 213 is inclined at less than 90 degrees with respect to the horizontal bar 211.

Figure 7:
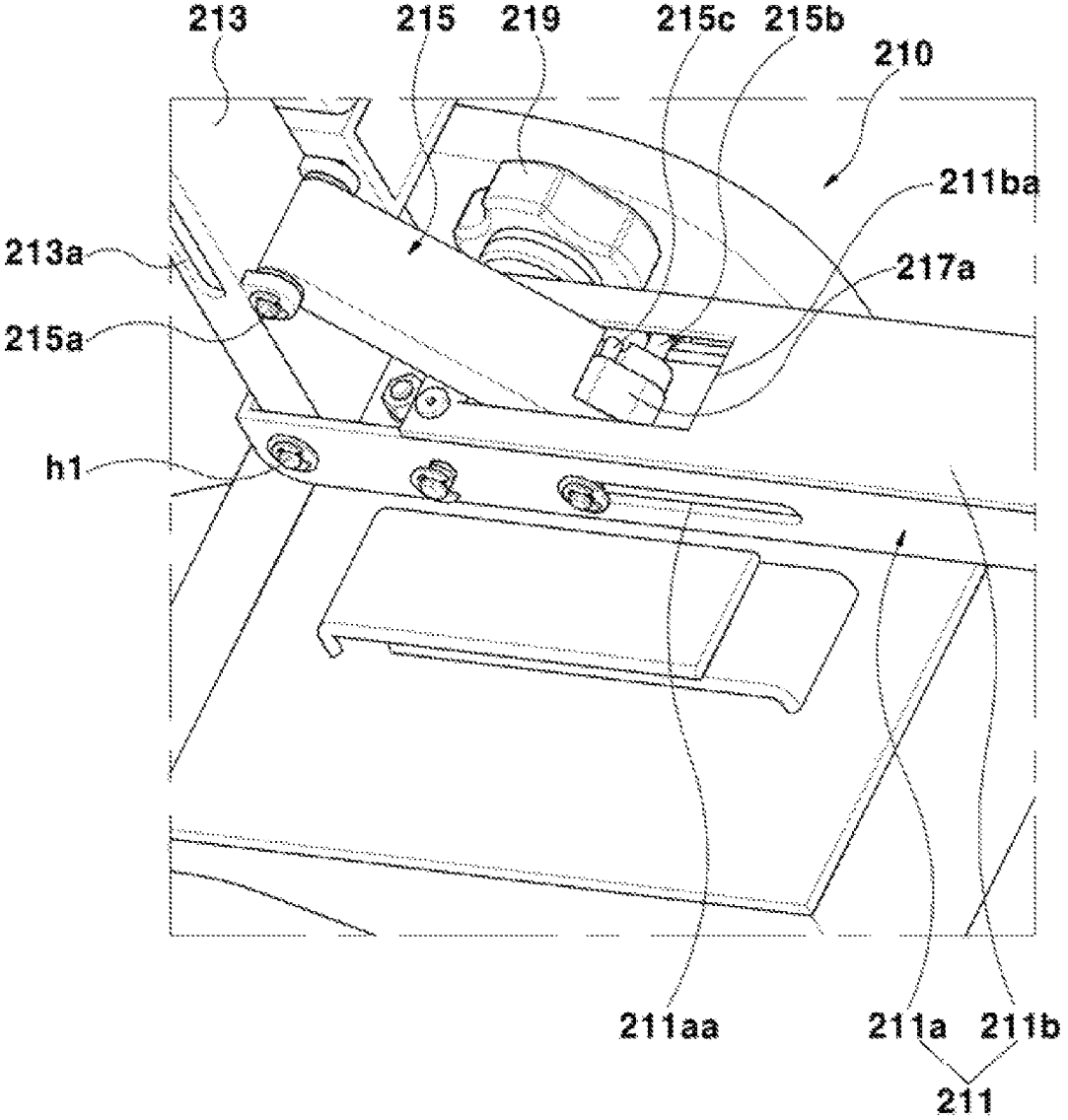
FIG. 7 is an enlarged view of the main part of the left exercise part of FIG. 3.

Referring to FIG. 7, the link bar 215 includes a hinge axis 215*a* formed at one end thereof, and is hinged as this hinge axis 215*a* is rotatably supported on one side of the vertical bar 213, and includes a moving shaft 215*b* at the other end thereof such that when the other end is inserted into the casing 211*a* through the through hole 211*ba,* the moving shaft 215*b* is inserted into a pair of rail grooves 211*aa* formed on both side walls of the casing 211*a* in the longitudinal direction, and accordingly and can be moved along the rail grooves 211*aa.*

That is, when the vertical bar 213 is pivoted from the state perpendicular to the horizontal bar 211 to the inclined state toward the horizontal bar 211, the moving shaft 215*b* provided at the other end of the link bar 215 is moved along the rail grooves 211*aa.*

Figure 8:
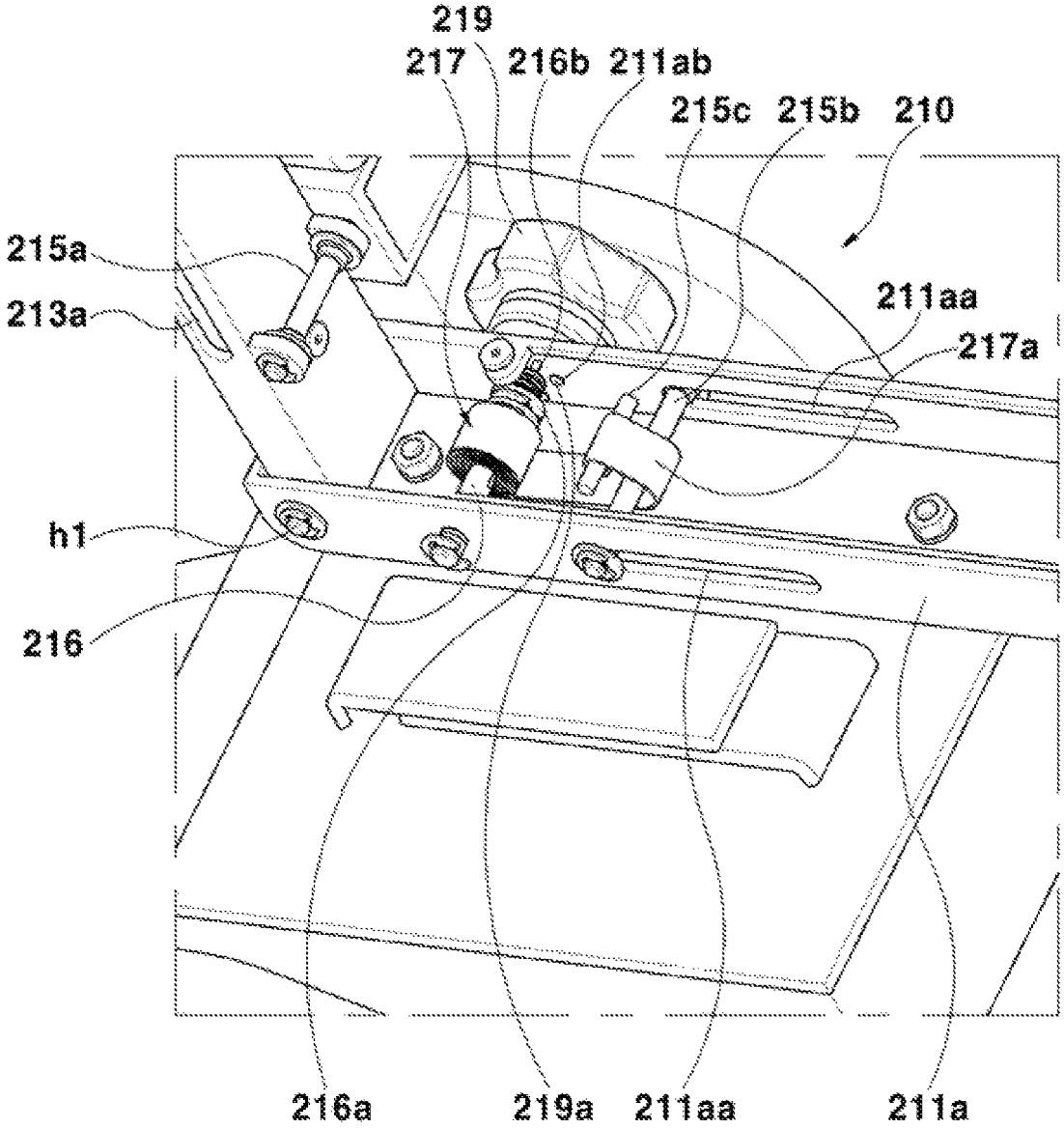
FIG. 8 is a view of FIG. 7 from which the cover plate is omitted.

As shown in FIGS. 7 and 8, the elastic member 217 is formed as a spiral spring and is provided inside the horizontal bar 211 and at a position between the terminal end of the horizontal bar 211 and the moving shaft 215*b*. The casing 211 of the horizontal bar 211 is provided with a fixed shaft 216 in a width direction to install the spiral spring 217, and the fixed shaft 216 is inserted into the spiral spring 217. At this time, an inner end of the spiral spring 217 is fixed to the fixed shaft 216.

An outer end 217*a* of the spiral spring 217 is fixed to the front end of the link bar 215. Specifically, a fastening pin 215*c* is fixedly provided at a front-end portion of the link bar 215 at a position spaced apart from the terminal end to the rear direction by a predetermined distance, and the outer end 217*a* of the spiral spring 217 is configured to surround the front end of the link bar 215 and be fixed to the fixing pin 215*c*.

With this configuration, when the vertical bar 213 is pivoted from the original state of being perpendicular to the horizontal bar 211 to the inclined state, the outer end 217*a* of the spiral spring 217 is moved along the link bar 215 in the direction farther away from the fixed shaft 216, and the spiral spring 217 generates an elastic restoring force to move the vertical bar 213 to the original perpendicular state. That is, the elastic force of the spiral spring 217 for restoring the vertical bar 213 to the original state imparts a resistance against the user pushing the vertical bar 213 to the second state through the head contact part 238, so that the user's neck muscles are strengthened.

The head contact part 218 is a portion that comes into contact with the head of the user so that the user seated in the chair part 110 pushes the vertical bar 213 to the inclined state with respect to the horizontal bar 211, and it 218 may include a material having a cushioning property at a portion contacting the head, and has a form of a ring shape to prevent the ear or the like from being pressed as it 218 comes contact with the side surface of the head.

Figure 9:
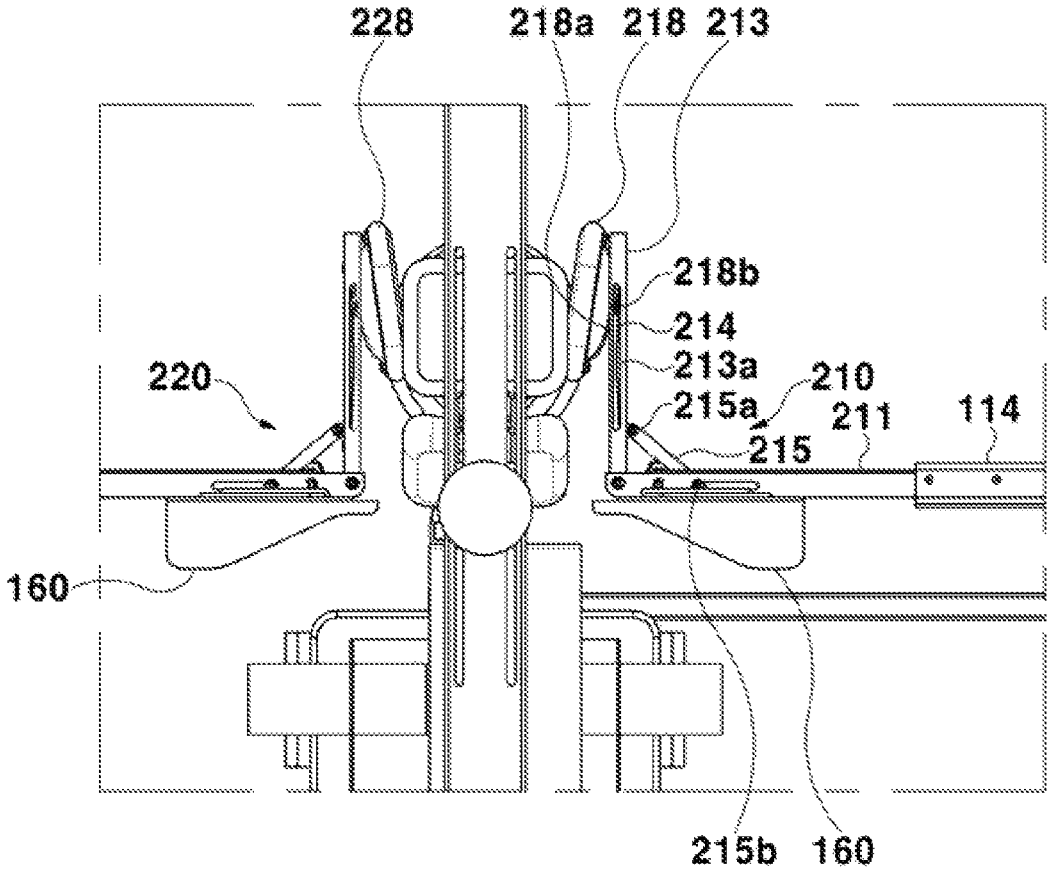
FIG. 9 is a partial rear view of a neck muscle exercise device according to an exemplary embodiment of the present disclosure.

Referring to FIG. 9, an arcuate support rib 218*a* is provided on the rear side of the head contact part 218 to connect the upper and lower ends, and a shaft 218*b* is provided in the middle position of the support rib 218*a* in a left and right width direction.

The shaft 218*b* is inserted into a pair of rail grooves 213*a* formed on both side walls of the vertical bar 213 along the longitudinal direction and moved along the rail grooves 213*a,* so that the head contact part 218 can be moved up and down along the longitudinal direction of the vertical bar 213.

Meanwhile, a plate spring 214 bent in the longitudinal direction is provided inside the vertical bar 213 so that the shaft 218*b* is prevented from moving unintentionally along the rail grooves 213*a* due to the weight of the head contact part 218. The plate spring 214 is configured to press the shaft 218*b* in one direction so that the shaft 218*b* is prevented from moving freely in the rail grooves 213*a* and is maintained in a semi-constrained state.

Therefore, without external force applied thereto, the shaft 218*b* is not lowered along the rail groove 213*a* simply by the self-weight of the head contact part 218, since both ends of the shaft 218*b* are pushed to one side of the rail grooves 213*a* while being inserted into the rail groove 213*a*. When the user pushes the head contact part 218 with his head, the shaft 218*b* can move along the rail grooves 213*a* while overcoming the elastic force of the plate spring 214. On the other hand, when the user removes the external force that pushes the contact portion 218, the shaft 218*b* is brought back to the semi-restrained state by the elastic force of the spiral spring 214 and fixed in position without being moved along the rail grooves 213*a*.

Meanwhile, the present disclosure has a structure capable of adjusting the elastic force of the spiral spring 217. Specifically, referring to FIG. 8, a disc 216*a* is provided at one side of the spiral spring 217 to be fixed to the fixed shaft 216, and a coil spring 216*b* is inserted between the disc 217*a* and the side wall of the casing 211*a* while being inserted into the fixed shaft 216. In addition, a plurality of fastening holes 211*ab* are circumferentially penetrated through an outer periphery of the fixed shaft 216 on the side wall of the casing 211*a,* and the fixed shaft 216 is passed through the one side wall of the casing 211*a*. A circular operation knob 219 for grip by the user is provided at one end of the fixed shaft 216, and a fastening protrusion 219*a*, which can be inserted into the plurality of fastening holes 211*ab*, is formed on a front surface of the operation knob 219.

With the above configuration, the user pulls the operation knob 219 to a retreated position to cause the fastening protrusion 219*a* to be released from the fastening hole 211*ab*. In this state, the operation knob 219 is rotated in one direction, and then, when the external force pulling the operation knob 219 is removed, the fastening protrusion 219*a* is inserted into the corresponding fastening hole 211*ab* in front of the fastening protrusion 219*a*, by the elastic force of the coil spring 216 so that the fixed shaft 216 is fixed in a rotation-limited state.

In the above, as the operation knob 219 is rotated in one direction, the fixed shaft 216 is rotated together, resulting in the spiral spring 217 rotating together. Since one end 217*a* of the spiral spring 217 is fixed to the other end of the link bar 215, the elastic force of the spiral spring 217 is changed as the winding state (i.e., number of winding) of the spiral spring 217 around the fixed shaft 216 is changed. The user may increase the elastic force of the spiral spring 217 by rotating the operation knob 219 in one direction, and decrease the elastic force of the spiral spring 217 by rotating the operation knob 219 in the other direction. That is, since the user is able to adjust the elastic force of the spiral spring 217 by operating the operation knob 219, the user is able to adjust the resistance imparted against the motion of pushing the head contact part 218, and thus, easily control the intensity of the exercise.

In addition, in the present disclosure, shoulder cushion parts 160 for smoothly wrapping and supporting a shoulder may be provided under the left exercise part 210 and the right exercise part 220, that is, under the horizontal bars 211 of the left exercise part 210 and the right exercise part 220, respectively. The shoulder cushion part 160 may include a cushioning material such as a sponge in an area to be contacted with the shoulder to smoothly press and support the shoulder of the user who is seated in the chair part 150.

In the present disclosure, the head contact part 238 of the backward exercise part 230 supports the back of the head, and has a form of a rectangular plate, rather than a ring. In addition, an area that comes into contact with the back of the head is formed of a cushioning material, and is formed in a curved shape to surround the back of the head. In addition, the head contact part 248 of the front exercise part 240 may have a form of a ring to be brought into contact with a periphery of face without pressing the eyes, nose, and mouth, and may include a cushioning material in an area that comes into contact with the periphery of face.

Figure 6:
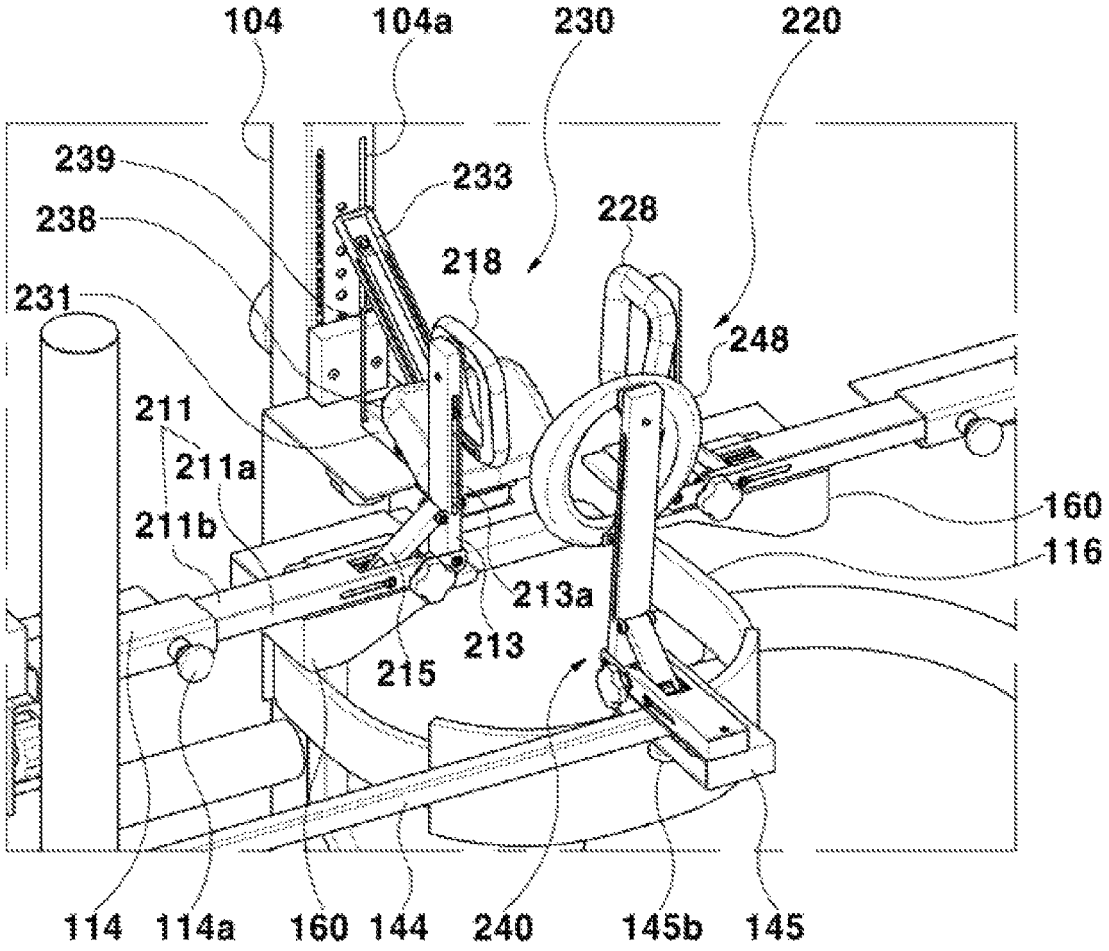
FIG. 6 is an enlarged view of the main part of FIG. 3 seen from another angle.

As shown in FIGS. 1, 3, and 6, in a structure according to an embodiment of the present disclosure, the horizontal bar 231 is fixed to the upper surface of the angle 133 of the rear support bracket 130 and the backward exercise part 230 is provided directly on the rear support bracket 130. At this time, the backward exercise part 230 may include slope maintaining members 239 of a "ㄷ" shape, which are pivotably formed on both side walls of the rear end of the horizontal bar 231. In an embodiment, when the user does not perform the rear head exercise, the slope maintaining members 239 may be hooked on a hook 239*a* fixedly provided on a rear surface of the vertical bar 233, so that even in the absence of an external force exerted to the vertical bar 233, the vertical bar 233 in the inclined second state is maintained in the inclined second state (i.e., in a state perpendicular to the horizontal bar 231) without returning to the first state.

Hereinafter, an example of use of a neck muscle exercise device according to an embodiment of the present disclosure will be described with reference to the drawings.

With the neck muscle exercise device according to the present embodiment, when the user is seated in the chair part 110, it is possible that the body of the user is fastened with the fastening members 155 and 156 to restrict movements, and performs the neck exercise in any one of front, back, left and right directions.

Figure 10:
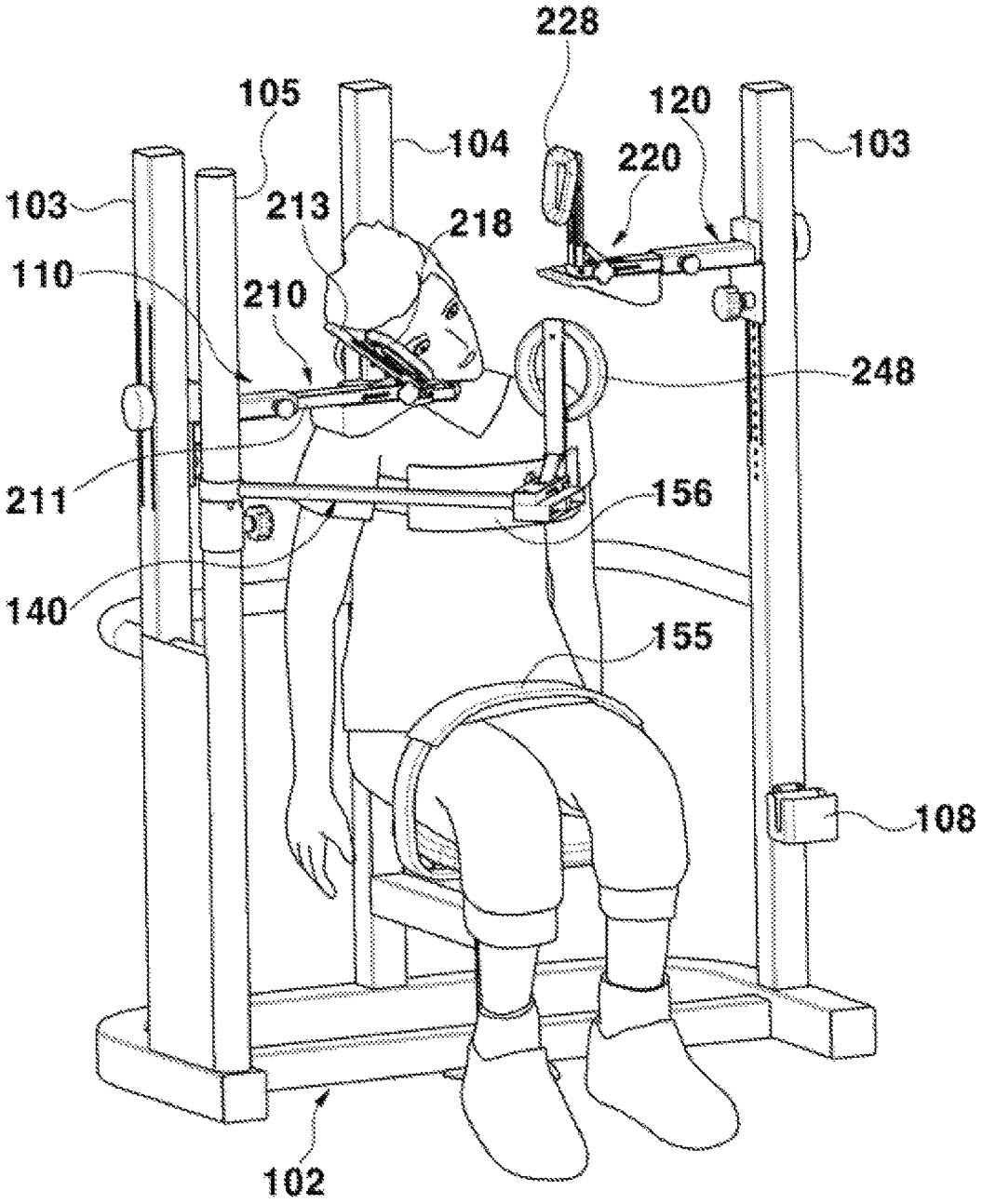
FIG. 10 is a view showing an example of using a neck muscle exercise device according to a first embodiment of the present disclosure.

This will be explained in detail by referring to FIGS. 1 and 10. While sitting in the chair part 110, the user may perform the exercise for strengthening the neck muscles by repeating a motion of inclining his head to the right and returning the head back using the left exercise part 210.

Before beginning exercise, the user may move the right exercise part 220, the backward exercise part 230, and the front exercise part 240 farther away from the head of the user, that is, away from the head exercise area of the user, except for the left exercise part 210.

That is, the user may raise the right support bracket 120 to above the side beam 103 so that the right exercise part 220 is positioned at a height above the head, hook the slope maintaining member 239 on the hook 239*a* at the rear side of the vertical bar 233 so that the vertical bar 233 is maintained in the inclined state to cause the head contact part 238 of the backward exercise part 240 to be moved apart from the back of the head of the user, and then rotate the extension bar 144 of the front support bracket 140 with respect to the front beam 105 to cause the front exercise part 240 to be moved apart from the face of user.

Accordingly, with the right exercise part 220, the backward exercise part 230, and the front exercise part 240 being positioned apart from the exercise area as described above, the user is seated in the chair part 150 and then fastens the thighs (lower body) and the chest (upper body) with the lower body fastening member 155 and the upper body fastening member 156 so that the body (lower and upper bodies) is held from moving.

At this time, the user may fasten his body by himself with the lower body fastening member 155 and the upper body fastening member 156, or have assistance from a helper (e.g., nurse).

While the side of the head is in contact with the head contact part 218, when the user starts a motion of pushing the head to the right to the inclined state, the head contact part 218 is slidingly moved to the lower portion of the vertical bar 213, and accordingly, the vertical bar 213 is pivoted to a direction of folding toward the horizontal bar 211 (second state). In this case, the spiral spring 217 generates an elastic force for returning the vertical bar 213 to the original state (first state) where the vertical bar 213 is perpendicular to the horizontal bar 211, thus imparting a resistance against the motion of the user pushing his head and strengthening the neck muscle of the user.

The user inclines his head to the right while pushing the head contact part 218, and then gradually moves his head back to the original state, according to which the vertical bar 213 is returned to the first state perpendicular to the horizontal bar 211 by the elastic force of the spiral spring 217. At this time, by the operation of the vertical bar 213 returning to the perpendicular state, the head contact part 218 is tightly pressed against the side of the head, and the user's ears are held inside the ring of the head contact part 218. As a result, the head contact part 218 is moved to the upper part of the vertical bar 213 and returned to the original position.

By repeating the motion of inclining the head to the right and then returning back to the original state, the user is able to do the exercise to strengthen the neck muscle.

Meanwhile, upon completing the rightward neck exercise using the left exercise part 110, the user may then perform the leftward neck exercise using the right exercise part 120 in the same manner. Likewise, using the head contact part 238 of the backward exercise part 230, the user may repeat a motion of pushing the head (back of the head) backward and returning to the original position, and while keeping the head contact part 248 of the front exercise part 130 in close contact with the head (face), the user may repeat a motion of pushing the head (face) forward and returning to the original position, thus strengthening the neck muscles. At this time, the exercise parts except the exercise parts in use may be positioned away from the area where the neck muscle exercise is performed.

As described above, the present disclosure enables efficient neck exercise and provides maximized exercise effect, since the user is able to do neck exercise while being seated in the chair part 150 and restricting the movement of the body with the fastening members 155 and 156.

If the user has to push the head contact parts 218, 228, 238, and 238 with his head without fastening his upper and lower bodies, the user would not concentrate his force on the neck muscles, but instead flex the other muscles such as shoulder muscles, and the like, which will deteriorate the effect of the neck muscle exercise. However, in the present disclosure, since the exercise is performed while the movement of the upper and lower bodies is restricted, the neck exercise may be performed with the correct postures, thereby increasing the efficiency of neck muscle exercise.

Particularly, in the present disclosure, since the user is able to selectively perform neck muscle exercises in four directions of front, back, left and right directions while being seated in the chair part 150 without changing the seating direction, the user is able to do more efficient neck exercise.

Meanwhile, when using a neck muscle exercise device according to the present disclosure, the user may input maximum muscular strength value (R value) of his neck muscle to an app installed on his smart phone, in which case the user may be able to perform the neck muscle exercise while listening to the exercise method suitable for his own neck muscle through the app. In addition, the user may record the history of neck exercise in the app.

Hereinafter, a neck muscle exercise device according to a second embodiment of the present disclosure will be described with reference to FIGS. 11 to 25.

Figure 11:
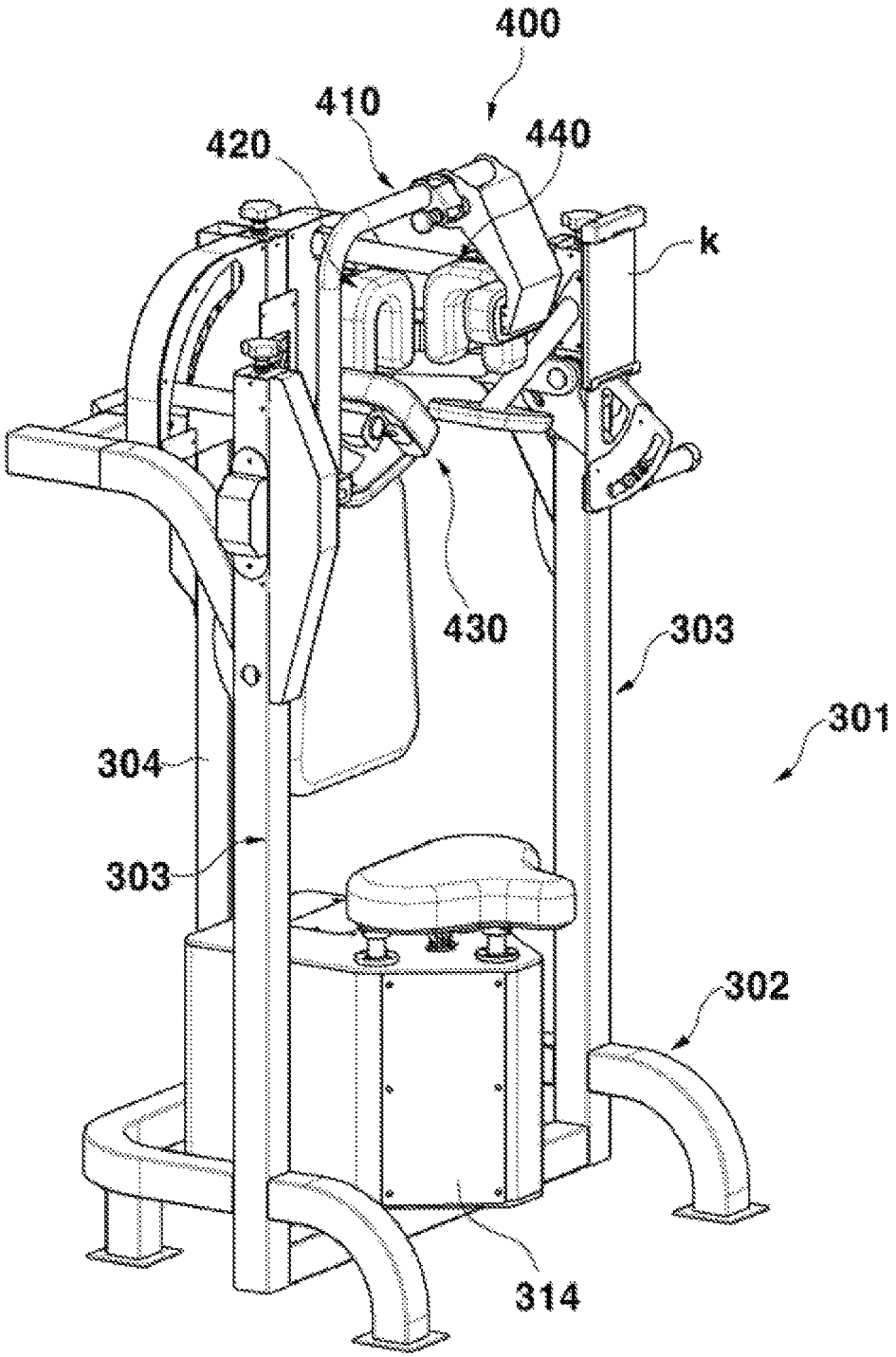
FIG. 11 is a perspective view of a neck muscle exercise device according to a second embodiment of the present disclosure.
Figure 12:
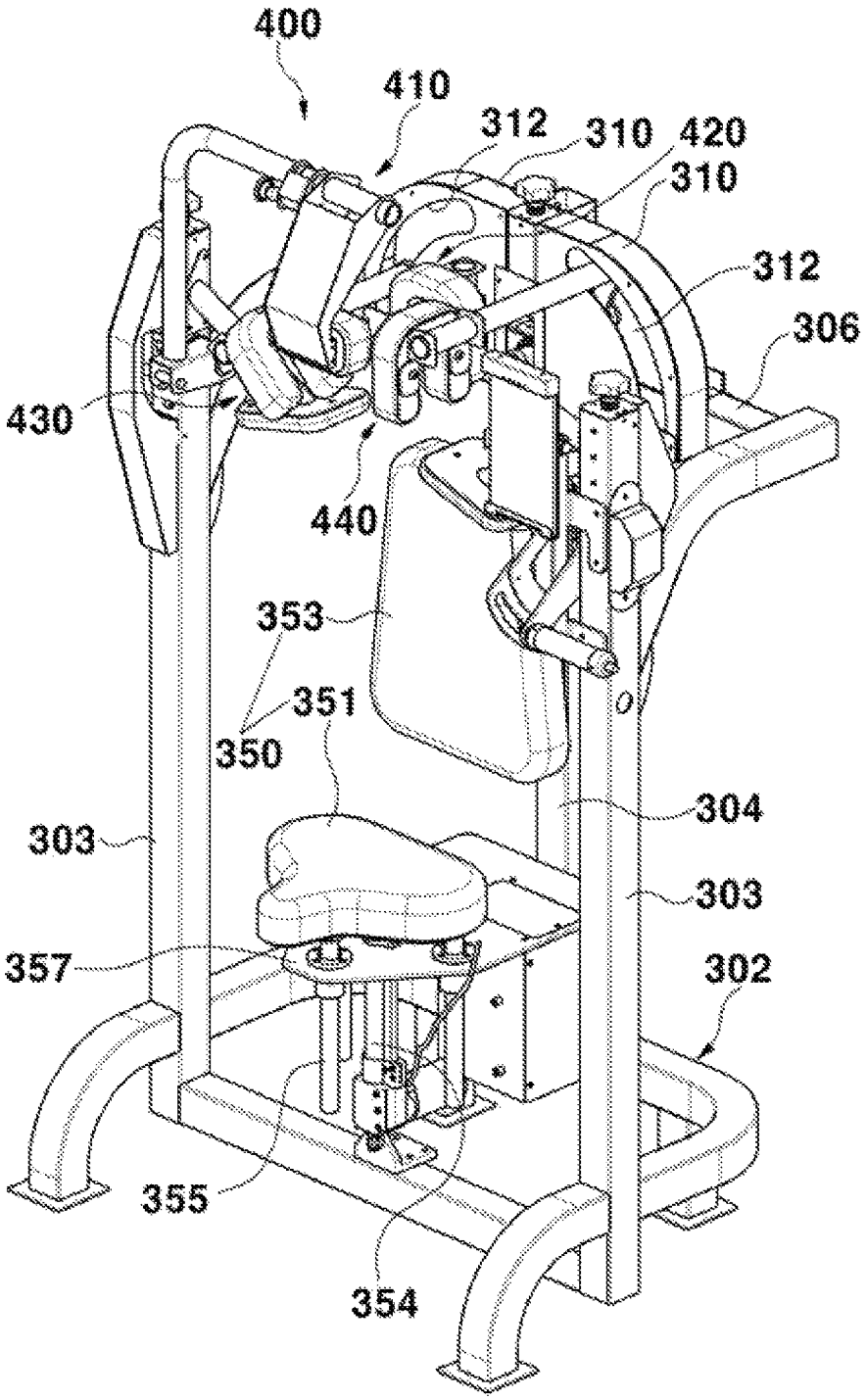
FIG. 12 is a perspective view of the neck muscle exercise device of FIG. 11 seen from another direction.
Figure 13:
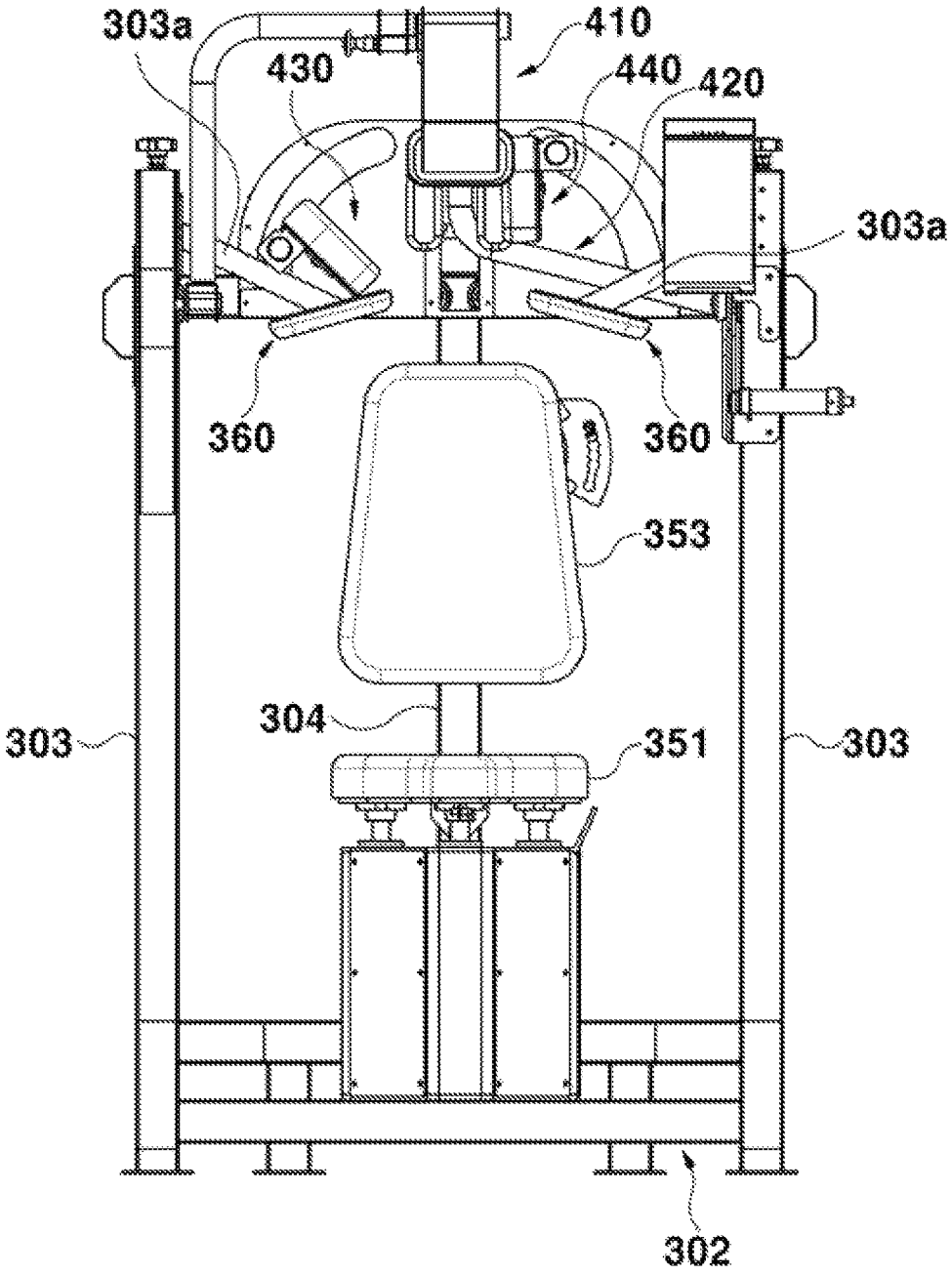
FIG. 13 is a front view of a neck muscle exercise device according to the second embodiment of the present disclosure.

For reference, FIG. 11 is a perspective view of a neck muscle exercise device according to a second embodiment of the present disclosure, FIG. 12 is a perspective view of the neck muscle exercise device of FIG. 11 seen from another direction, FIG. 13 is a front view of a neck muscle exercise device according to the second embodiment of the present disclosure, and FIGS. 11 to 13 show the user sitting in the chair part 350 and performing the leftward neck muscle exercise by inclining the head to the right while pushing the left exercise part 430. FIGS. 14 to 25 below show a state in which the left exercise part 430 is pushed and pivoted by the head of the user.

Referring to FIGS. 11 to 13, the neck muscle exercise device according to the second embodiment includes the chair part 350 and push exercise parts 400. The chair part 350 and the push exercise parts 400 are provided at the main body part 301. Further, although not shown, the chair part 350 may be provided with the fastening members 155 and 156 described in the first embodiment.

The main body part 101 includes a base frame 301 supported on the floor, and vertical frames 303 and 304 extending perpendicularly upward from the base frame 102.

The vertical frames 303 and 304 include a pair of side beams 303 provided on the left and right sides of the seat part 351 with respect to the seat part 351 of the chair part 350, and a rear beam 304 provided at a rear side of the seat part 351. Here, the pair of side beams 303 and the rear beam 304 have a form of a square tube, and a horizontal beam 306 horizontally extending to a left and right direction is formed above the rear beam 304.

Components of the push exercise parts 400, that is, a front exercise part 410, a backward exercise part 420, a left exercise part 430 and a right exercise part 440 are provided on the upper parts of the pair of the side beams 303 and the rear beam 104, respectively.

The front exercise part 410 is provided on the upper part of the left side beam 303, the backward exercise part 420 is provided on the upper part of the right-side beam 303, and the left exercise part 430 and the right exercise part 440 are provided on the rear beam 104.

In addition, a grip-type holder k for holding electronic devices such as smart phones, tablets, and so on may be provided on the upper part of the right-side beam 303. The grip-type holder k may be configured in the same structure as a conventional smart phone holder for use in a vehicle in which grip parts on both sides press and fix both sides of an electronic device such as a smart phone. Meanwhile, an indicator lamp for indicating the operation state of various sensors may be provided on an upper end of the grip-type holder k.

The chair part 350 includes a seat part 351 and a backrest part 353.

The seat part 351 is provided on an upper part of a base casing 314 provided at the center of the base frame 302 to support the buttocks of the user.

At this time, the seat part 351 is adjustable with height in up and down direction by the electric cylinder 355.

The electric cylinder 355 is received in the base casing 314, with an upper end thereof being fixed to the lower end of the seat part 351 and a lower end being fixed to the base frame 302.

Therefore, the length of the electric cylinder 355 is extended or contracted according to the driving of the electric cylinder 355, and the height of the seat part 351 may be adjusted as the seat part 351 is moved up and down. The height of the seat part 351 may be appropriately adjusted according to the user's body size.

Meanwhile, three guide rods 357 extending downward are extended from the lower end of the seat part 351, and these guide rods 357 are passed through the base casing 314 to be slid up and down, so that when the seat part 351 is raised and lowered by the electric cylinder 355, the seat part 351 is stably moved up and down.

In addition, the present disclosure may include a remote controller (not illustrated) for controlling the operation of the electric cylinder 355. The user or the physical therapist may adjust the height of the seat part 351 by operating the electric cylinder 355 using the remote controller.

It should be noted that the present disclosure is not limited to controlling the electric cylinder 355 by operating with the remote controller, and accordingly, the electric cylinder 355 may be controlled by operating through an electronic device such as smart phone, tablet PC, and so on. For example, the electronic device may be held on the grip-type holder k, and the height of the seat part 351 may be appropriately adjusted by controlling the electric cylinder 355 by operating through the electronic device.

In addition, in an embodiment, the storage unit 108 of the first embodiment may be provided on one side of the side beam 303 to hold the remote controller therein.

The backrest part 353 is fixedly provided in front of the rear beam 304 to support the back of the user who is seated in the seat part 351.

Although not illustrated in the present disclosure, the fastening members 155 and 156 of the first embodiment may be provided on the seat part 351 and the backrest part 353 to fasten the thigh and chest of the user seated in the chair part 350 and restrict the movement of the user.

Meanwhile, in the present disclosure, shoulder cushion parts 360 may be provided at the terminal ends of extension rods 303*a* extending downwardly and inclining inwardly from the pair of side beams 303. The shoulder cushion parts 360 may include a cushioning material such as a sponge in an area to be contacted with the shoulder to smoothly press and support the shoulder of the user who is seated in the chair part 350.

The push exercise parts 400 include four parts, i.e., the front exercise part 410, the backward exercise part 420, the left exercise part 430 and the right exercise part 440. The push exercise parts 410, 420, 430, and 440 are provided on the pair of side beams 303 and the rear beam 304. The push exercise parts 400 strengthen the neck muscle of the user by imparting resistance against a motion of pushing the head in any of front, back, left and right directions while the user is seated in the chair part 350.

Figure 14:
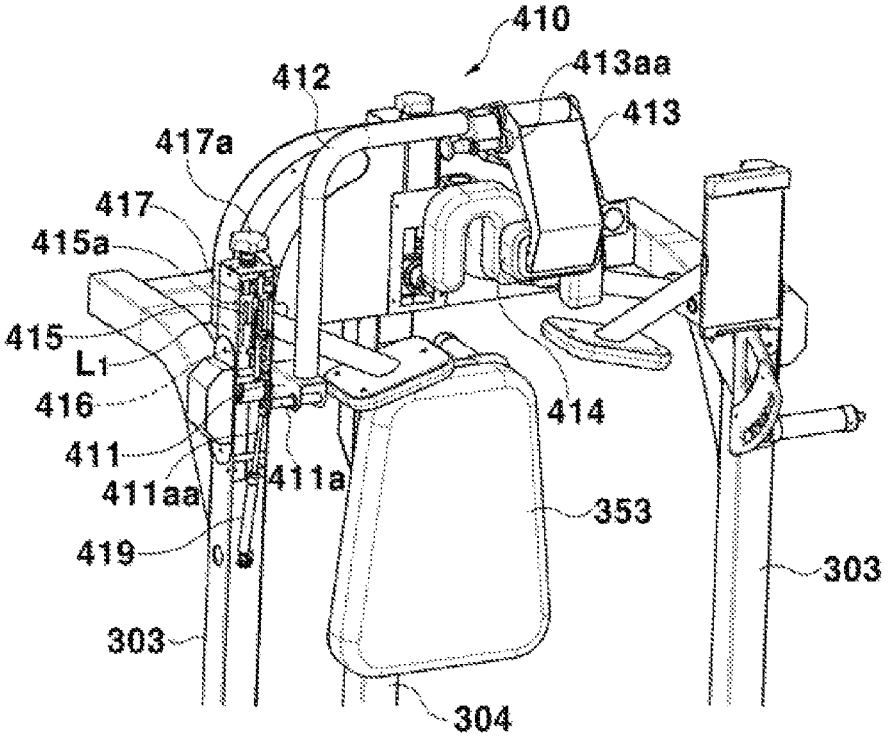
FIG. 14 is a view provided to explain a specific configuration of a front exercise part of the neck muscle exercise device shown in FIG. 11.

Referring to FIG. 14, the front exercise part 410 includes a pivot bar 411, an extension bar 412, a support 413, a front head contact part 414, and an elastic member 416.

The pivot bar 411 is pivotably provided on a side of the left side beam 303, and has a protruding pin 411*a* provided at a free end of the pivot bar 411, and the protruding pin 411*a* is protruded to the outside of the pivot bar 411.

A groove 411*a* for fixing the spring is formed at a terminal end of the protruding pin 411*a* in a ring shape along an outer circumferential surface.

The extension bar 412 has a form of a "ㄱ"-shaped rod and is provided at the free end of the pivot bar 411. The terminal end of the extension bar 412 is positioned above and in front of the head of the user when the user is seated in the chair part 350.

The support 413 is provided at a lower part of the terminal end of the extension bar 412 to cover the front side of the head of the user seated in the chair part 350.

The head contact part 414 is provided at the terminal end of the support 413 and includes a cushioning material in an area to be contacted with the head of the user.

The elastic member 416 has a form of a coil spring, of which one end is fixed to a ring 415*a* of a spring fixing member 415 formed inside the side beam 303 and the other end is fixed to the groove 411*aa* of the protruding pin 411*a*.

With the above configuration, when the user is seated in the chair part 350 and brings his head into contact with the head contact part 414 and pushes the head contact part 414 forward, the support 414, the extension bar 412, and the pivot bar 411 are pivoted forward, causing the elastic member 416 to be stretched, and accordingly, this imparts resistance against the head of the user by the elastic restoring force of the elastic member 416, thus strengthening the neck muscle of the user.

In the present disclosure, when the user pushes the head contact part 414 forward with the head and then returns the head to the original position, the support 414, the extension bar 412, and the pivot bar 411 are pivoted back to the original position by the elastic force of the elastic member 416, and in this situation, it may be difficult for the support 414, the extension bar 412, and the pivot bar 411 to be pivoted back the original position by the elastic force of the elastic member 416 alone. Accordingly, a hydraulic absorber 419 may be provided to connect the left side beam 303 and the terminal end of the protruding pin 411*a*. The hydraulic absorber 419 allows the support 414, the extension bar 412, and the pivot bar 411 to be more easily pivoted back to the original position.

In the present disclosure, the spring fixing member 415 formed inside the side beam 303 to fix one end of the elastic member 416 can be adjusted in position in up and down direction, in accordance with a rotating operation of a tension adjusting rod 417.

The spring fixing member 415 is connected to the inner surface of the side beam 303 by an LM guide L1, and is slidable up and down inside the side beam 303.

In addition, the tension adjusting rod 417 includes a rod member having threads formed on an outer circumferential surface thereof to be coupled with the spring fixing member 415 in a ball-screw manner. The upper end of the tension adjusting rod 417 is rotatably provided at the upper end of the left side beam 303 and a handle 417*a* is provided at the upper end of the tension adjusting rod 417.

Therefore, when the user grips the handle 417*a* and rotates the tension adjusting rod 417 in one direction, the spring fixing member 415 coupled to the tension adjusting rod 417 in the ball-screw manner is moved upward, so that the spring fixing member 415 is moved further away from the projecting pin 411*a*, causing the elastic member 416 to be stretched. On the other hand, when the user rotates the tension adjusting rod 417 in the other direction with the handle 417*a*, the distance between the spring fixing member 415 and the protruding pin 411*a* is decreased so that the elastic member 416 is contracted to a shorter length. In this manner, the tension of the elastic member 416 may be adjusted, and it is possible to easily adjust the intensity of exercise by adjusting the resistance imparted against the motion of the user pushing the head contact part 414.

In the present disclosure, as shown in FIG. 14, the support 413 protruding downward from the terminal end of the extension bar 412 would make it difficult for the user to sit in the chair part 350 for exercise, because it may be difficult for the user to sit in the chair part 350 and make a posture for the exercise since the head will be obstructed by the support 413.

Accordingly, in the present disclosure, the support 413 may be disposed at an exercise position where the support 413 is protruded downward from the terminal end of the extension bar 412 as shown in FIG. 14, or the support 413 may be disposed at a standby position where the support 413 is pivoted upward at the terminal end of the extension bar 412.

Figure 15:
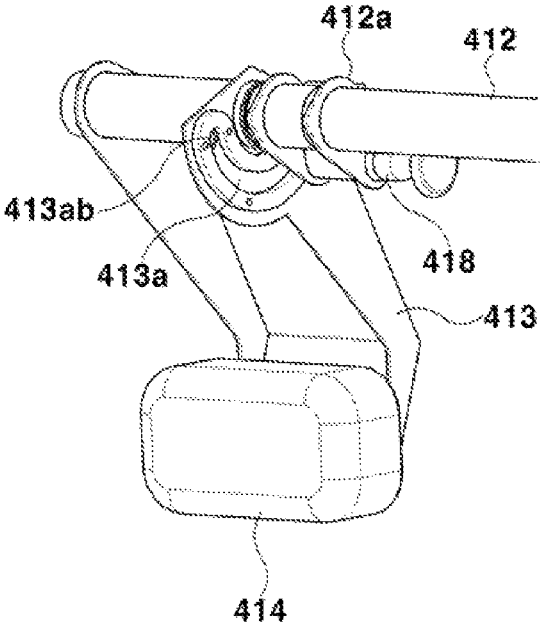
FIG. 15 is an enlarged view of a configuration of a portion of the front exercise part in FIG. 14.
Figure 16:
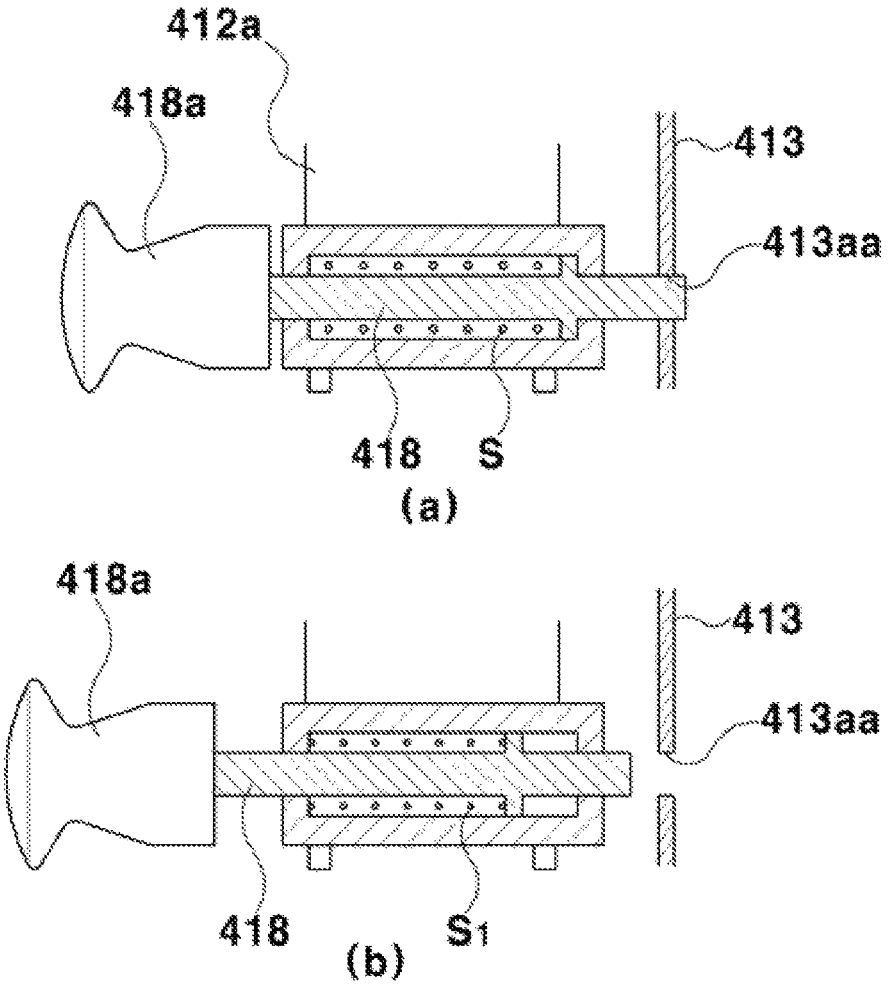
FIG. 16 is a view showing an operation state of the first position fixing pin of FIG. 15.

To this end, referring to FIGS. 14 and 15, the support 413 is rotatably provided at the terminal end of the extension bar 412, and a circular guide groove 413*a* is formed on a side surface of the support 413, and a first insertion hole 413*aa* and a second insertion hole 413*ab* are formed on both sides of the guide groove 413*a*.

A sliding support member 412*a* is provided at the terminal end of the extension bar 412 in proximity to the support 413, and a position fixing pin 418 is penetrated through the terminal end of the sliding support member 412*a* to be able to move forward toward the support 413 or backward.

Referring to 16, a spring s1 is disposed between the position fixing pin 418 and the sliding supporting member 412*a*, such that when the user holds the handle 418*a* formed at the rear end of the position fixing pin 418, pulls it back and then ceases exerting the external force, the position fixing pin 418 is advanced back to the original state by the elastic force of the spring s1.

When the terminal end of the position fixing pin 418 is inserted into the first insertion hole 413*a*, the support 413 may be fixed in position so that the support 413 is extended downward at the end of the extension bar 412, as shown in FIG. 14. In this state, when the user pulls the handle 418*a* and pivots the support 413 upward, the terminal end of the position fixing pin 418 is moved along the guide groove 413*a* to the position where the second insertion hole 413*ab* is provided. In this state, when the user ceases exerting the external force, the terminal end of the position fixing pin 418 is advanced to be inserted into the second insertion hole 413*ab* so that the position where the support 413 is pivoted upward from the terminal end of the extension bar 412 is fixed.

As described above, in order to sit in the chair part 350, the user may pivot the support 413 upward with respect to the extension bar 412 and fix the same in position, and then in order to perform the neck exercise, the user may pivot the support 413 downward with respect to the terminal end of the extension bar 412 and fix the same in position, as shown in FIG. 14.

In addition, in order to do exercise using one of the backward exercise part 420, the left exercise part 430 and the right exercise part 430, the user may raise the support 413 above the extension bar 412, away from the head exercise area.

Figure 17:
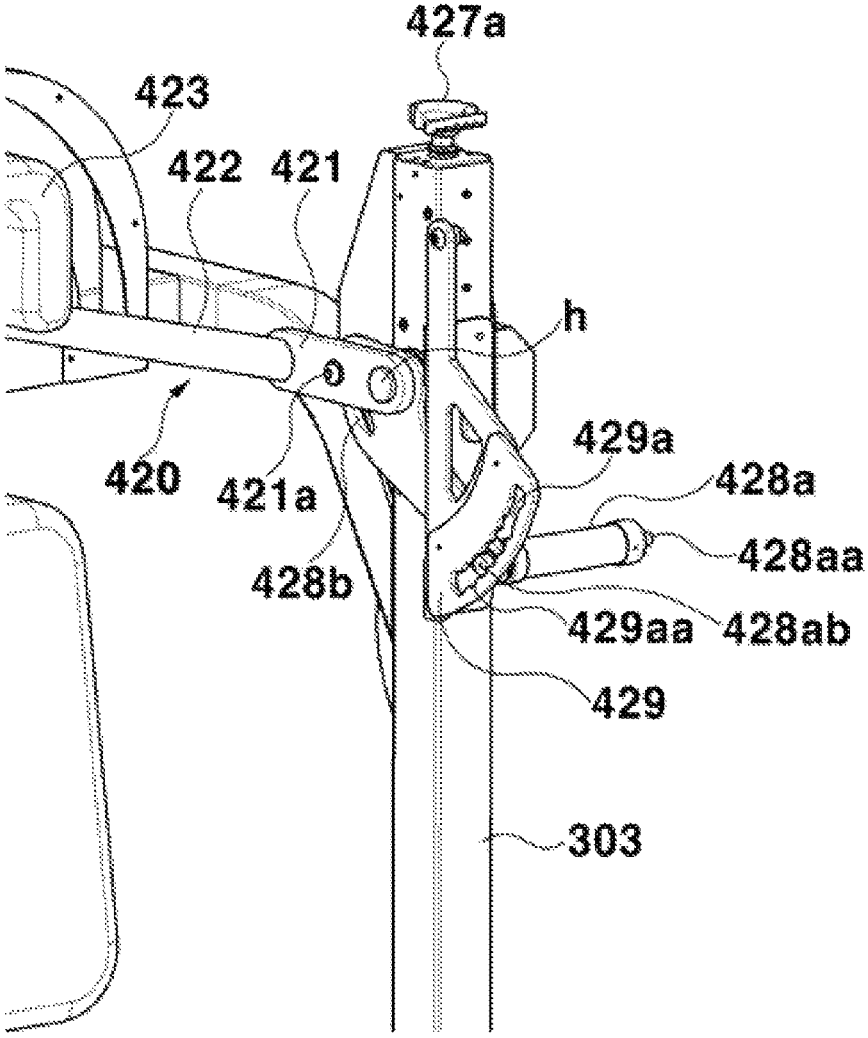
FIG. 17 is a view provided to explain a specific configuration of a backward exercise part of the neck muscle exercise device shown in FIG. 11.
Figure 18:
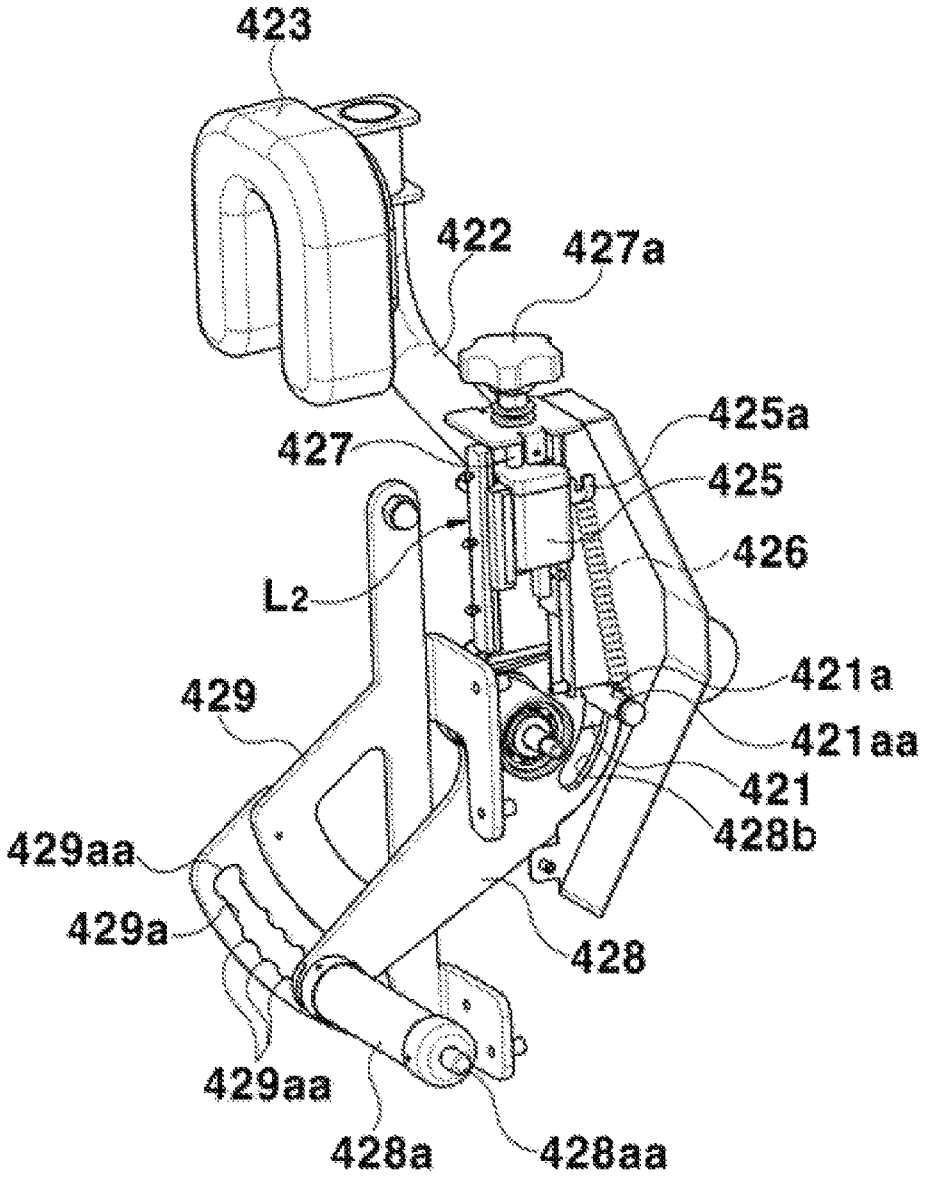
FIG. 18 is a view of FIG. 17 from which the configuration of the side beams is omitted to explain a configuration provided inside the side beams of the vertical beam.

Referring to FIGS. 17 and 18, the backward exercise part 420 is provided on the upper part of the right-side beam 303.

The backward exercise part 420 includes a pivot bar 421, an extension bar 422, a head contact part 423, and an elastic member 426.

The pivot bar 421 is configured such that one end is coupled to the side beam 303 on the right side to be pivoted by the hinge h, a protruding pin 421*a* formed at a center part, and a spring fixing groove 421*aa* is formed at a terminal end of the protruding pin 421*a*.

The extension bar 422 is extended from the other end of the pivot bar 421. The terminal end of the extension bar 422 is positioned in back of the head of the user when the user is seated in the chair part 350.

The head contact part 423 is fixed at the terminal end of the extension bar 422 and includes a cushioning material in an area to be contacted with the head of the user.

The elastic member 426 has a form of a coil spring, of which one end is fixed to a ring 425*a* of a spring fixing member 425 formed inside the right-side beam 303 and the other end is fixed to the spring fixing groove 421*aa* of the protruding pin 421*a*.

The user is seated in the chair part 350, brings the back of the head into contact with the head contact part 443, and inclines and pushes the head backward, such that the pivot bar 421 and the extension bar 422 are pivoted backward, causing the elastic member 426 to be extended, thus generating a restoring elastic force of the elastic member 426 to return to the original state and a resistance against a motion of the user pushing his head, thus strengthening the neck muscle of the user.

Meanwhile, the spring fixing member 425 has the same form as the front exercise part 410 and is capable of adjusting the tension of the elastic member 426 by adjusting the vertical position at the upper part of the inner side of the right-side beam 303, so that the strength of the neck exercise can be controlled.

Specifically, the spring fixing member 425 is connected to the inner surface of the right side beam 303 by the LM guide L2, an upper end of the tension adjusting rod 427 is rotatable on the upper end of the right side beam 303, and the tension adjusting rod 427 is coupled with the spring fixing member 425 in a ball-screw manner, such that the user is easily able to adjust the tension of the elastic member 426 by adjusting the vertical position of the spring fixing member 425 by rotating the handle 417*a* of the tension adjusting rod 427.

Meanwhile, according to an exemplary embodiment, the backward exercise part 420 is moved to a position away from the head of the user, i.e., away from the head exercise area of the user, when the user does not perform the backward neck exercise.

Specifically, according to an exemplary embodiment, the backward exercise part 420 is pivotably provided on the hinge h of the pivot bar 412, and may further include a pivot operation piece 428 having a grip part 428*a* provided at one end for pivoting the pivot bar 412 in accordance with the operation of the user, and a locking piece 429 for fixing the pivot operation piece 428 in the pivoted position.

The pivot operation piece 428 is hinged at the same position as the hinge axis h of the pivot bar 421, and includes a guide hole 428*b* having a predetermined arc formed at one end and the grip part 428*a* provided at the other end for grip by the user. The protruding pin 421*a* is inserted into the guide hole 428*b* to be moved along the circular guide hole 428*b* during neck exercise when the user pushes the head contact part 423 backward and causing the pivot bar 421 to be pivoted.

The locking piece 429 is fixed to the right-side beam 303, and has an arcuate pin movement guide hole 429*a* formed at a lower side thereof, and a plurality of pin insertion holes 429*aa* formed in the pin movement guide hole 429*a* at predetermined intervals, in a larger size than the movement guide hole 429*a*.

Figure 19:
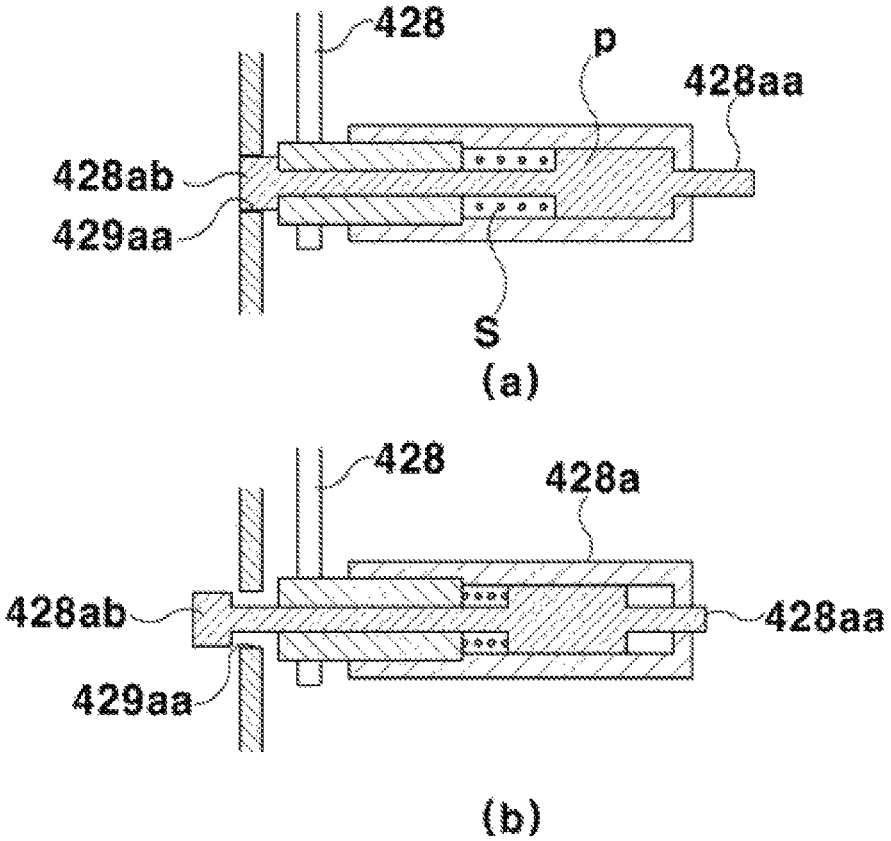
FIG. 19 is a view showing an operation state of the second position fixing pin of FIG. 17.

Referring to FIG. 19, the grip part 428*a* is provided with a locking pin p that is movable forward or backward, a press part 428*aa* provided at the rear end of the locking pin p to be pressed by the user, and an extension 428*ab* formed at the front end with a larger diameter than the rear end. A spring s is provided between the locking pin p and the grip part 428 so that the locking pin p is retracted to the original state when the external force exerted on the press part 428*aa* is removed.

As shown in FIG. 19B, when the user presses the press part 428*aa*, the extension 428*ab* is advanced and disengaged from the pin insertion hole 429*aa*, so that the pivot operation piece 428 is now pivotable. Then, when the user removes the external force from the press part 428*aa*, the locking portion p is retracted to the original state and the extension 428*ab* is inserted into any one of the pluralities of pin insertion holes 429*aa*, so that the pivoting of the pivot operating piece 428 is restricted.

With the above configuration, in the state as shown in FIG. 18, when the user holds the grip part 428*a* and lifts it up, while pushing the press part 428*aa*, the pivot operation piece 429 is pivoted and accordingly, one end of the pivot operation piece 429 is pivoted downward, forcibly lowering the protruding pin 421*a* by the guide hole 428*b*, so that the pivot bar 421 is pivoted downward, and the extension bar 412 and the head contact part 423 are also pivoted backward, moving away from the back of the head of the user sitting in the chair part 350 to a position farther away from the head exercise area. In this state, when the external force applied to the press part 428*aa* is removed, the extension 428*ab* is inserted into the uppermost pin insertion hole 429*aa* to fix the pivot operation piece 428 in the pivoted position, and the extension bar 412 and the head contact part 423 are maintained at a position moved farther away from the neck exercise area.

On the other hand, when the user intends to perform the backward neck muscle exercise using the backward exercise part 420, the extension bar 422 and the head contact part 423 may be restored back to the original positions by the motion reverse to that described above, so that when the extension bar 422 and the head contact part 423 are positioned back in the exercise enabled area, the user may continue the neck muscle exercise.

In addition, according to an exemplary embodiment, by adjusting the angle of the pivot operation piece 428 by inserting the extension 428*ab* into any pin insertion hole 429*a* of the plurality of pin insertion holes 429*aa,* it is possible to adjust the angle of the pivot bar 421 and the user sitting in the chair part 350 is able to customize a distance between the head contact part 423 and the back of the head according to the user's body size and perform the backward neck exercise.

Referring to FIGS. 20 to 25, the left exercise part 430 according to an exemplary embodiment includes a pivot bar 431, an extension bar 432, a head contact part 433, and an elastic member 436.

The pivot bar 431 is pivotably provided on the horizontal beam 306 formed on the upper part of the rear beam 304.

The extension bar 432 extends from the terminal end of the pivot bar 431 to the front, such that a terminal end thereof is positioned at the right side of the head of the user sitting in the chair part 350.

The head contact part 433 is provided at the terminal end of the extension bar 432 and may include a cushioning material in an area to be contacted with the head of the user.

The elastic member 436 has a form of a coil spring, of which one end is fixed to the rear beam 304 and the other end is fixed to a hook part 431*a* formed on one side of the pivot bar 431. Specifically, a protruding casing 308 is provided at the upper end of the rear beam 304, and a spring fixing member 451 is provided in the protruding casing 308, in which one end of the elastic member 436 is fixed to a first ring portion 451*a* formed on the left side of the spring fixing member 451, and the other end is fixed to a hook part 431*a* formed in the middle portion of the pivot bar 431.

The user is seated in the chair part 350, brings the right side of the head into contact with the head contact part 443, and inclines and pushes the head to the right, such that the pivot bar 431 is pivoted, causing the elastic member 426 to be extended, thus generating a restoring elastic force to return to the original state and a resistance against the head of the user, thus strengthening the neck muscle of the user.

Likewise, the right exercise part 440 includes a pivot bar 441, an extension bar 442, a head contact part 443, and an elastic member 446. The right exercise part 440 is configured symmetrically with the left exercise part 430. At this time, one end of the elastic member 436 is fixed to a second ring portion 451*b* formed on the right side of the spring fixing member 451, and the other end is fixed to a hook part 441*a* formed in the middle portion of the pivot bar 441.

When using the right exercise part 440, likewise the left exercise part 430, the user is seated in the chair part 350, brings the left side of the head into contact with the head contact part 443, and inclines and pushes the head to the left, such that the pivot bar 441 is pivoted, causing the elastic member 426 to be extended, thus generating a restoring elastic force to return to the original state and a resistance against the head of the user, thus strengthening the neck muscle of the user.

Figure 20:
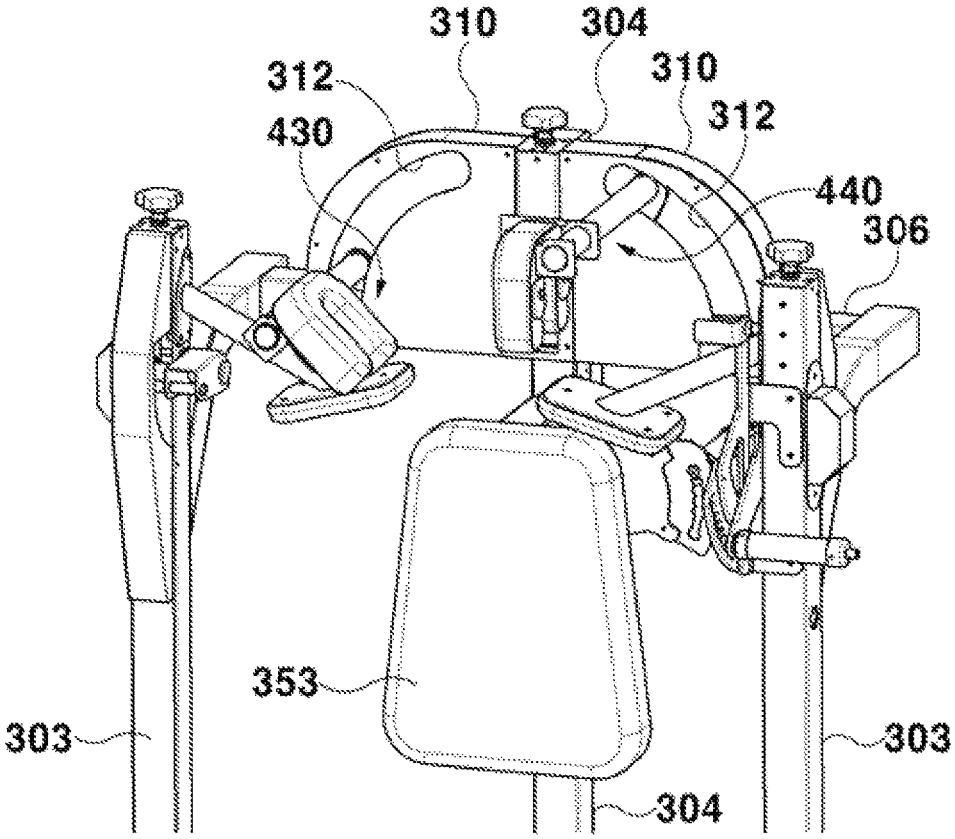
FIG. 20 is a view provided to explain left and right exercise parts of the neck muscle exercise device shown in FIG. 11.
Figure 21:
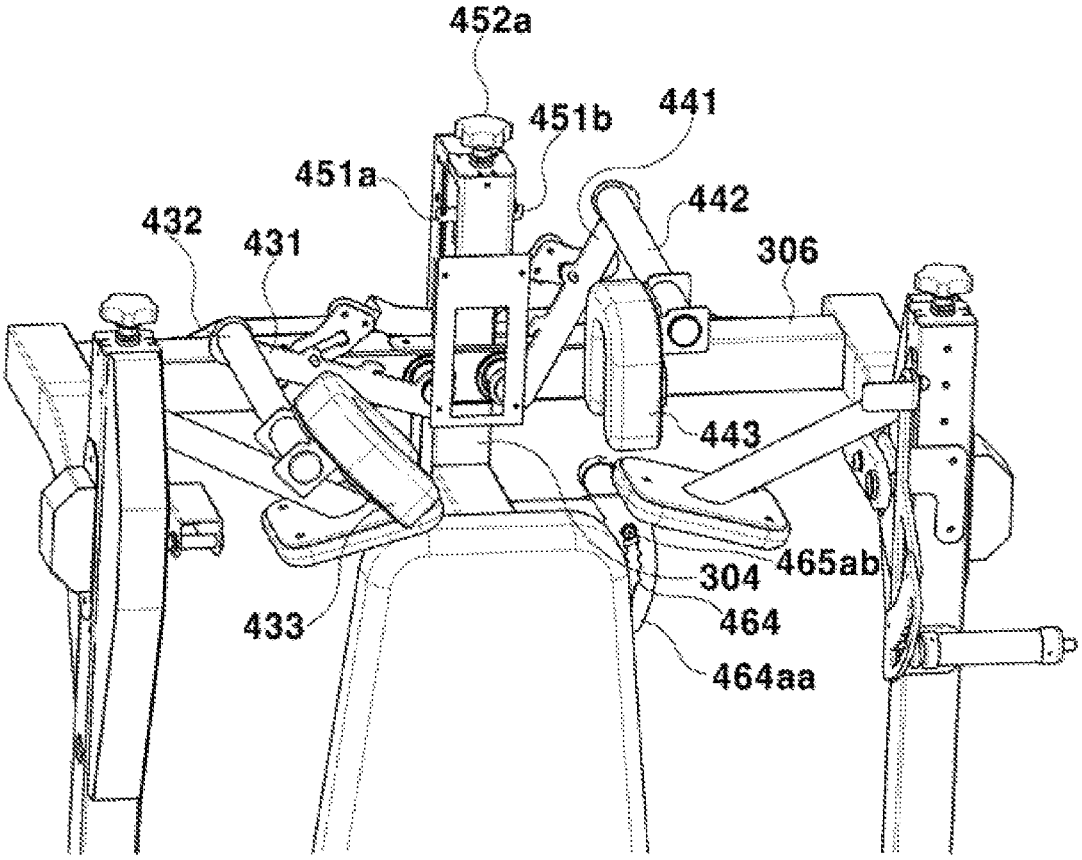
FIG. 21 is a view of FIG. 20 from which the configuration of the cover casing is omitted.
Figure 22:
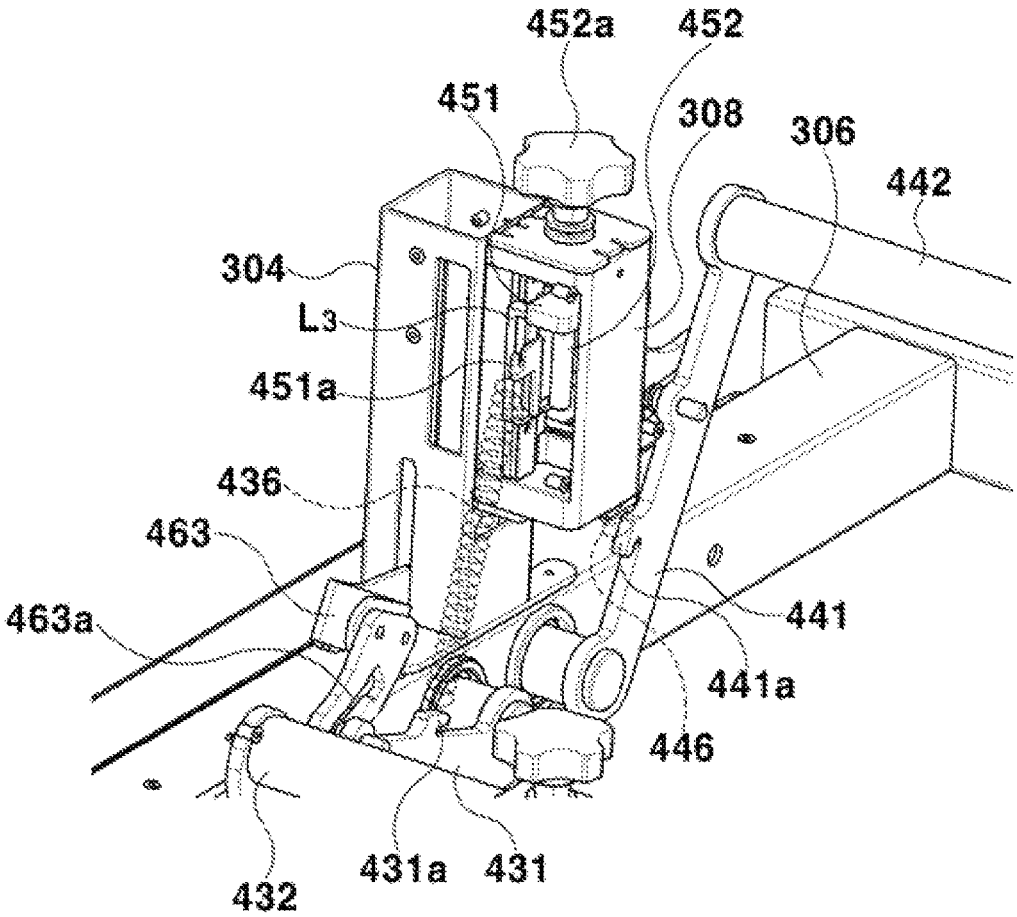
FIG. 22 is an enlarged view of a configuration of a portion of the tension adjusting rod shown in FIG. 21.
Figure 23:
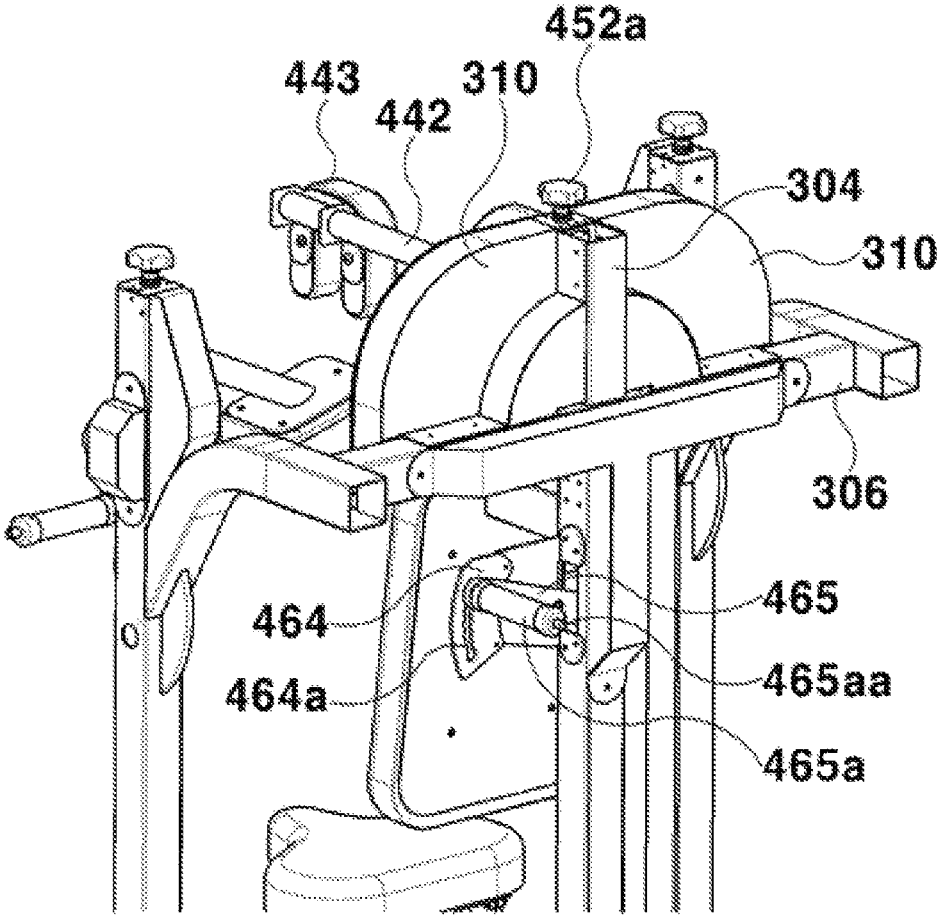
FIG. 23 is a view showing the neck muscle exercise device of FIG. 11 seen from behind, which is provided to explain the left and right exercise parts of the neck muscle exercise device.
Figure 24:
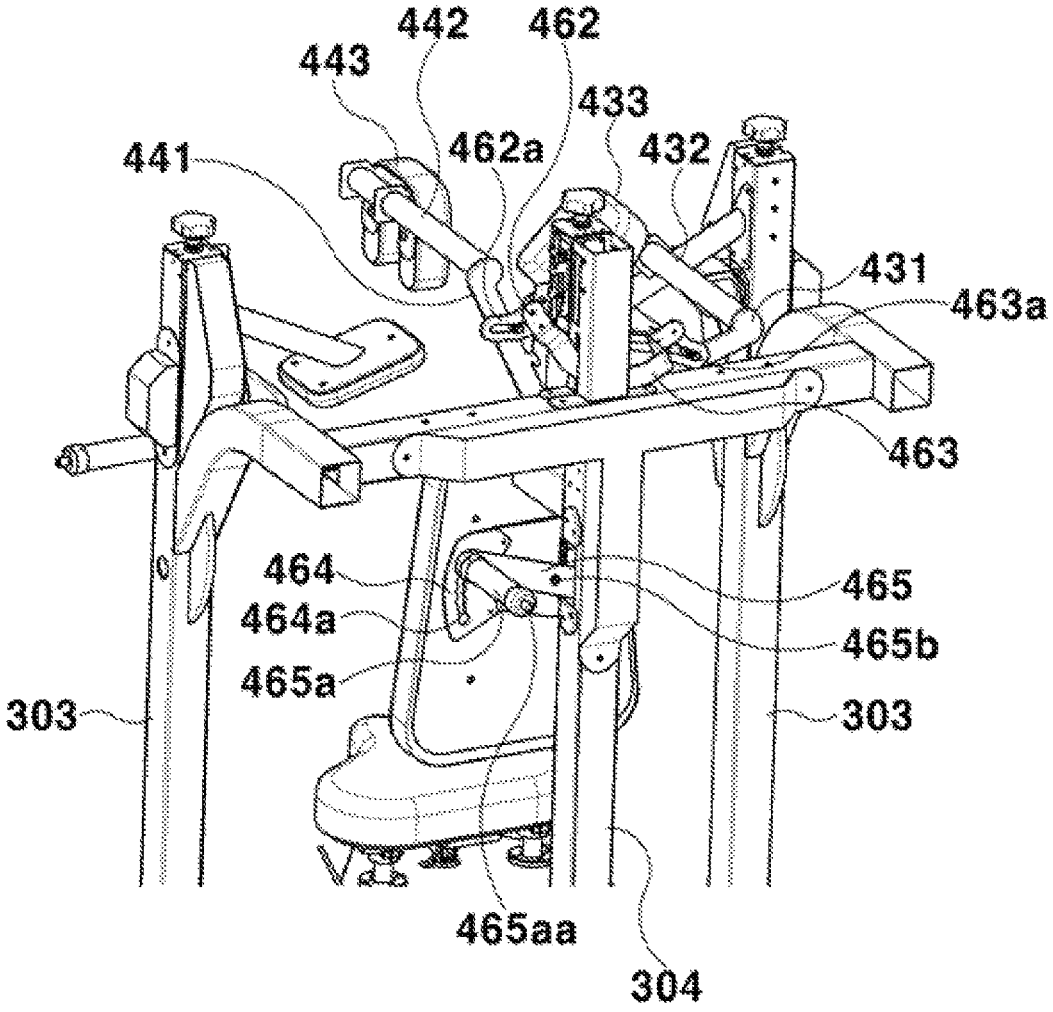
FIG. 24 is a view of FIG. 23 from which the configuration of the cover casing is omitted.
Figure 25:
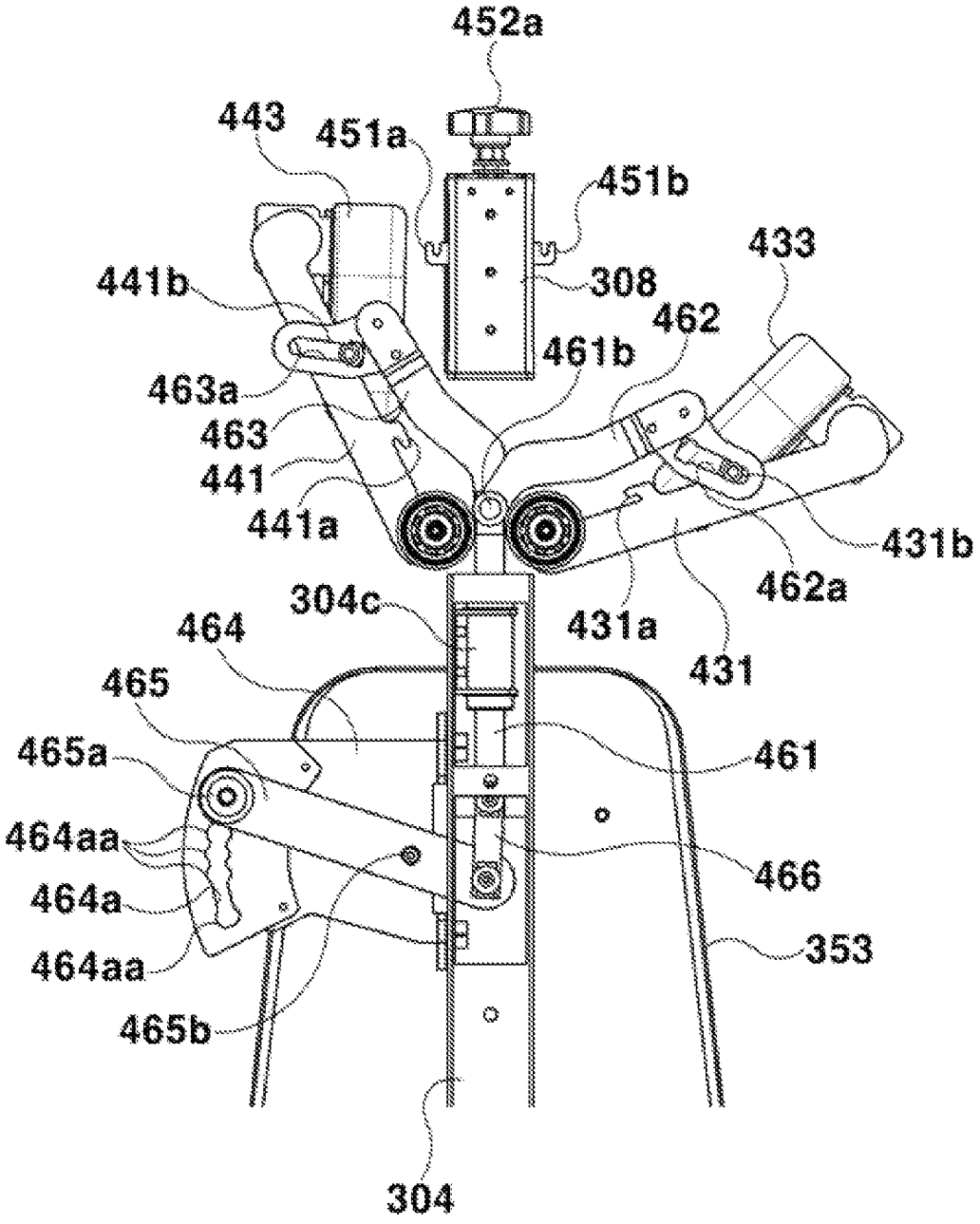
FIG. 25 is a view of FIG. 24 from which an upper part of the rear beam is omitted to explain a configuration provided inside the upper part of the rear beam.

According to the present disclosure, as shown in FIG. 20, a cover casing 310 surrounding the pivot bar 431 of the left exercise part 430 and the pivot bar 441 of the right exercise part 440 may be provided in the horizontal beam 306, and long holes 312 in the form of an arc may be formed on the left and right sides of the front surface of the cover casing 310, respectively, such that the extension bar 432 of the left exercise part 430 and the extension bar 442 of the right exercise part 440 passed through the respective long holes 312 can be moved along the long holes 312.

In the present disclosure, the spring fixing member 451 is vertically adjustable in the same manner for the front exercise part 410 and the backward exercise part 420, and thus is capable of adjusting the tension of the elastic member 436 of the left exercise part 430 and the elastic member 446 of the right exercise part 440 at the same time.

That is, the spring fixing member 451 according to an exemplary embodiment is connected to the inside of the protruding casing 308 by the LM guide L3, the tension adjusting rod 452 is coupled with the spring fixing member 451 in a ball-screw manner, and the upper end of the tension adjusting rod 452 is rotatable on the upper end of the protruding casing 308. Accordingly, by adjusting the height of the spring fixing member 451 by moving the spring fixing member 451 upward or downward by rotating the handle 452*a* of the tension adjusting rod 452, the user is able to adjust the tension of each of the elastic members 436 and 446 to adjust the intensity of exercise.

Meanwhile, according to an exemplary embodiment, the left exercise part 430 and the right exercise part 440 may be moved to a position away from the head of the user, i.e., away from the head exercise area of the user, when the user does not perform the left and right neck exercises.

To this end, the present disclosure may be provided with an elevation shaft 461, first and second connection pieces 462 and 463, a locking piece 464, and a pivot operation piece 465.

The elevation shaft 461 is vertically movable while being inserted in a sliding tube 304*c* provided inside the rear beam 304.

One end of the first connecting piece 462 is hingedly provided at the upper end of the elevation shaft 461 and the other end has a guide hole 462*a* of a predetermined length formed therein. A pin 431*b* protruding rearward from the middle part of the pivot bar 431 is inserted into the guide hole 462*a,* such that, when the user pushes the head contact part 433 to the right to cause the pivot bar 431 to pivot during the neck exercise, the pin 431*b* is moved to an edge of the guide hole 462*a,* and then the first connecting piece 462 is also moved together with the pivot bar 431 by the pin 431*b*.

The second connecting piece 463 is symmetrical with the first connecting piece 462. One end of the second connecting piece 463 is hingedly provided at the upper end of the elevation shaft 461 and the other end has a guide hole 463*a* of a predetermined length formed therein. A pin 441*b* protruding rearward from the middle part of the pivot bar 441 is inserted into the guide hole 463*a,* such that, when the user pushes the head contact part 443 to the left to cause the pivot bar 441 to pivot during the neck exercise, the pin 441*b* is moved to an edge of the guide hole 463*a*, and then the first connecting piece 464 is also moved together with the pivot bar 441.

Like the locking piece 429 of the backward exercise part 430, the locking piece 464 is provided with a pin movement guide hole 464*a* and a pin insertion hole 464*aa* spaced apart along the pin movement guide hole 464*a*, the locking piece 464 is fixed to one side of the upper part of the rear beam 304.

The pivot operation piece 465 is pivotable on the locking piece 464 by a hinge pin 465*b*, and one end thereof is connected to the lower end of the elevation shaft 461 by a link piece 466 and the other end is provided with a grip part 465*a*. At this time, both ends of the link piece 466 are hingedly connected to the lower end of the elevation shaft 461 and one end of the pivot operation piece 465, respectively.

The grip part 465*a* has a same form as the grip part 428*a* of the backward exercise part 430. That is, the grip part 465*a* is provided with a locking pin that is movable forward or backward, a press part 465*aa* provided at the rear end of the locking pin to be pressed by the user, and an extension 465*ab* formed at the front end with a larger diameter than the rear end, and a spring is provided inside the grip part 465*a* to cause the extension 465*ab* to be retracted back to the original state upon removal of the external force pressing on the press part 428*aa*.

That is, according to the present disclosure, when the user presses the press part 428*aa*, the extension 465*ab* is advanced and disengaged from the pin insertion hole 464*aa*, so that the pivot operation piece 465 is now pivotable. Then, when the user removes the external force from the press part 465*aa*, the extension 428*ab* is retracted and inserted into any one of the pluralities of pin insertion holes 465*aa*, so that the pivoting of the pivot operating piece 465 is restricted.

With the above configuration, when the user grasps the grip part 465*a* and lowers the grip part 465*a*, while pressing the press part 465*aa*, one end of the opposite side of the pivot operation piece 465 is raised to the upper side, causing the elevation shaft 461 to be raised. As a result, the first connecting piece 462 and the second connecting piece 463 are split apart from each other to forcibly push the pins 431*b* and 441*b* of the respective pivot bars 431 and 441 to both sides, so that the respective pivot bars 431 and 441 are spread apart from each other by an adjusted angle, and the extension bars 432 and 442 and the head contact parts 433 and 443 are moved away from the left and right sides of the head of the user seated in the chair part 350 to be placed at a position deviated from the head exercise area. In this state, when the external force applied to the press part 465*aa* is removed, the extension 465*ab* is inserted into the lowermost pin insertion hole 464*aa* to fix the pivot operation piece 465 in the pivoted position, and the pivot bars 431 and 441, the extension bars 432 and 442 and the head contact parts 433 and 443 can be maintained in the position moved farther away from the neck exercise area.

On the other hand, when the user intends to perform the left and right neck muscle exercises using the left exercise part 430 and the right exercise part 440, the extension bars 432 and 442 and the head contact parts 433 and 443 may be restored back to the original positions by the operation reverse to that described above, so that when the extension bars 432 and 442 and the head contact parts 433 and 443 are positioned back in the exercise enabled area, the user may continue the neck muscle exercise.

In addition, according to an exemplary embodiment, by adjusting the angle of the pivot operation piece 465 by inserting the extension 465*ab* into any pin insertion hole 464*a* of the plurality of pin insertion holes 464*aa*, it is possible to adjust the angle of the pivot bars 431 and 441 and the user sitting in the chair part 350 is able to customize distances between the head contact part 433 and 443 and both sides of the head according to the user's body size and perform the left and right neck exercises.

While the present disclosure has been particularly shown and described with reference to exemplary embodiments thereof, it is to be understood that the invention is not limited to the disclosed exemplary embodiments. It will be appreciated by those skilled in the art that numerous changes and modifications of the invention are possible without departing from the spirit and scope of the appended claims. Accordingly, all such modifications and variations are intended to fall within the scope of the present disclosure.

INDUSTRIAL APPLICABILITY

The present disclosure relates to a neck muscle exercise device, and is widely applicable in the exercise equipment industry or rehabilitation therapy equipment industry.

DESCRIPTION OF REFERENCE NUMERALS

101: Main body
102: Base frame
103: Side beam
104: Rear beam
105: Front beam
103*a*, 104*a*: Slit
103*b*,104*b*,105*a*: Pin hole
110: Left support bracket
111: Sliding member
111*a*: Penetrating bar
111*b*: Front block
111*c*: Rear block
111*d*: Connecting piece
112: Spring
113: Angle
114: Support beam
115: Pin member
120: Right support bracket
130: Rear support bracket
140: Front support bracket
141: Lower cylinder
143: Upper cylinder
144: Extension bar
145: Support
150: Chair part
151: Seat part
153: Backrest
155: Lower body fixing member
156: Upper body fixing member
160: Shoulder cushion part
200: Push exercise part
210: Left exercise part
211: Horizontal bar
213: Vertical bar
215: Link bar
216: Fixed shaft
217: Spiral spring
218: Face contact part
219: Operation knob
220: Right exercise part
230: backward exercise part
240: Front exercise part

301: Main body
302: Base frame
303: Side beam
304: Rear beam
306: Horizontal beam
350: Chair part
351: Seat part
353: Backrest
410: Front exercise part
420: Backward exercise part
430: Left exercise part
440: Right exercise part

The invention claimed is:

1. A neck muscle exercise device, comprising:

a main body part;

a chair part provided at the main body part, having a seat part for supporting a user's buttocks such that the user sits thereon, and formed such that a height of the seat part can be adjusted by an electric cylinder; and push exercise parts provided at the main body part so as to be arranged at an upper part of the chair part, and applying resistance to a motion of the user who is sitting on the chair part and pushing his head in at least one direction, so as to strengthen the user's neck muscle, wherein the push exercise parts are formed into four parts, and each of the four push exercise parts is provided at the main body part so as to be respectively arranged at a front, back, left and right of the upper part of the chair part, and applies resistance to a motion, in which the head of the user sitting on the chair part is pushed in one random direction among a front, back, left and right directions, so as to strengthen the neck muscle of the user.

2. The neck muscle exercise device of claim 1, wherein the main body comprises:

a base frame supported on a floor; and a vertical frame provided perpendicularly to the base frame and having the push exercise parts provided thereon.

3. The neck muscle exercise device of claim 2, wherein the chair part further comprises a backrest part provided at the vertical frame to support a back of the user.

4. The neck muscle exercise device of claim 3, further comprising:

a fastening member provided on the chair part to fasten a body of the user who is seated in the chair part to restrict a movement of the user, wherein the fastening member comprises:

lower body fastening members provided at both ends of the seat part to band thighs of the user to restrict the movement of the user; and upper body fastening members provided at both ends of the backrest part to band an upper body of the user located in front of the backrest part to restrict movement.

5. The neck muscle exercise device of claim 4, wherein the vertical frame comprises:

a pair of side beams disposed on left and right sides of the seat part, respectively; and a rear beam disposed in back of the seat part.

6. The neck muscle exercise device of claim 5, wherein the push exercise parts comprise:

a front exercise part provided on a left side beam of the pair of side beams to strengthen the neck muscle by imparting resistance against a motion of the user pushing his head to the front direction;

a backward exercise part provided on a right-side beam of the pair of side beams to strengthen the neck muscle by imparting resistance against a motion of the user pushing his head to the back direction; and left and right exercise parts provided on the rear beam to strengthen the neck muscle by imparting resistance against a motion of the user pushing his head to the left and right directions.

7. The neck muscle exercise device of claim 6, wherein each of the left and right exercise parts, the backward exercise part and the front exercise part comprises:

a pivot bar pivotably provided on the vertical frame;

an extension bar extending from the pivot bar and having a terminal end positioned on front, back, left, or right sides of the head of the user;

a head contact part provided on the extension bar to be contacted with the front, back, left, and right sides of the head of the user; and an elastic member provided to connect the vertical frame and the pivot bar to impart a resistance to the neck of the user with respect to a motion of the user pushing the head contact part to front, back, left and right directions.

8. The neck muscle exercise device of claim 7, wherein the vertical frame is provided with a spring fixing member thereon for fixing one end of the elastic member of the left exercise part, the right exercise part, the front exercise part or the backward exercise part, and the spring fixing member is vertically adjustable in position.

9. The neck muscle exercise device of claim 8, further comprising:

a tension adjusting rod for adjusting tension of the elastic member of the left exercise part, the right exercise part, the front exercise part or the backward exercise part, which is rotatably provided in the vertical frame and coupled with the spring fixing member in a ball-screw manner to vertically adjust the position of the spring fixing member when a handle provided at an upper end of the tension adjusting rod is rotated.

10. The neck muscle exercise device of claim 9, further comprising:

a shoulder cushion part provided on the pair of side beams to fix and support a shoulder of the user sitting in the chair part.

11. The neck muscle exercise device of claim 7, wherein the front exercise part further comprises a hydraulic absorber which is provided to connect the pivot bar and the vertical frame to reinforce a force by which the pivot bar is restored to an original state by the elastic member after the user pushes the head contact part to the front direction.

12. The neck muscle exercise device of claim 7, wherein the front exercise part comprises a support provided at an end of the extension bar, and the head contact part is provided on the support, wherein the support is disposed upward at the end of the extension bar to allow the user to sit in the chair part, or during the neck exercise, the support is disposed downward at the end of the extension bar so that the support is positioned in front of the head of the user.

13. The neck muscle exercise device of claim 7, wherein each of the backward exercise part, and the left and right exercise parts is provided so as to be able to adjust an angle of the pivot bar with respect to the vertical frame, such that the head contact part is placed away from the head of the user to a position farther away from an area where the neck exercise is performed.

14. A neck muscle exercise device, comprising:

a main body part comprising:

a base frame supported on a floor; and a vertical frame provided perpendicularly to the base frame and having push exercise parts provided thereon; and a chair part provided at the main body part, having a seat part for supporting a user's buttocks such that the user sits thereon, and formed such that a height of the seat part can be adjusted by an electric cylinder;

wherein the push exercise parts are provided at the main body part so as to be arranged at an upper part of the chair part, and applying resistance to a motion of the user who is sitting on the chair part and pushing his head in at least one direction, so as to strengthen the user's neck muscle.

15. The neck muscle exercise device of claim 14, wherein the chair part further comprises a backrest part provided at the vertical frame to support a back of the user.

16. The neck muscle exercise device of claim 15, further comprising:

a fastening member provided on the chair part to fasten a body of the user who is seated in the chair part to restrict a movement of the user, wherein the fastening member comprises:

lower body fastening members provided at both ends of the seat part to band thighs of the user to restrict the movement of the user; and upper body fastening members provided at both ends of the backrest part to band an upper body of the user located in front of the backrest part to restrict movement.

17. The neck muscle exercise device of claim 16, wherein the vertical frame comprises:

a pair of side beams disposed on left and right sides of the seat part, respectively; and a rear beam disposed in back of the seat part.

18. The neck muscle exercise device of claim 17, wherein the push exercise parts comprise:

a front exercise part provided on a left side beam of the pair of side beams to strengthen the neck muscle by imparting resistance against a motion of the user pushing his head to the front direction;

a backward exercise part provided on a right-side beam of the pair of side beams to strengthen the neck muscle by imparting resistance against a motion of the user pushing his head to the back direction; and left and right exercise parts provided on the rear beam to strengthen the neck muscle by imparting resistance against a motion of the user pushing his head to the left and right directions.

19. The neck muscle exercise device of claim 18, wherein each of the left and right exercise parts, the backward exercise part and the front exercise part comprises:

a pivot bar pivotably provided on the vertical frame;

an extension bar extending from the pivot bar and having a terminal end positioned on front, back, left, or right sides of the head of the user;

a head contact part provided on the extension bar to be contacted with the front, back, left, and right sides of the head of the user; and an elastic member provided to connect the vertical frame and the pivot bar to impart a resistance to the neck of the user with respect to a motion of the user pushing the head contact part to front, back, left and right directions.

20. The neck muscle exercise device of claim 19, wherein the vertical frame is provided with a spring fixing member thereon for fixing one end of the elastic member of the left exercise part, the right exercise part, the front exercise part or the backward exercise part, and the spring fixing member is vertically adjustable in position.

* * * * *